US007295798B2

(12) United States Patent
Koyama

(10) Patent No.: US 7,295,798 B2
(45) Date of Patent: Nov. 13, 2007

(54) DEVELOPER SUPPLY DEVICE AND IMAGE FORMING APPARATUS INCLUDING THE SAME

(75) Inventor: Kazuya Koyama, Ikoma (JP)

(73) Assignee: Sharp Kabushiki Kaisha, Osaka (JP)

( * ) Notice: Subject to any disclaimer, the term of this patent is extended or adjusted under 35 U.S.C. 154(b) by 309 days.

(21) Appl. No.: 11/174,548

(22) Filed: Jul. 6, 2005

(65) Prior Publication Data

US 2006/0008298 A1 Jan. 12, 2006

(30) Foreign Application Priority Data

Jul. 7, 2004 (JP) ..... 2004-201143

(51) Int. Cl.
*G03G 15/08* (2006.01)

(52) U.S. Cl. ..... 399/258; 399/262

(58) Field of Classification Search ..... 399/107, 399/119, 120, 252, 258, 260, 262; 222/DIG. 1
See application file for complete search history.

(56) References Cited

U.S. PATENT DOCUMENTS 5,455,662 A 10/1995 Ichikawa et al.
5,612,769 A 3/1997 Sugihara et al.
6,334,037 B1 12/2001 Ise
7,130,566 B2 * 10/2006 Nagahama et al. ..... 399/262
7,174,120 B2 * 2/2007 Koyama et al. ..... 399/258
2005/0123323 A1 6/2005 Koyama et al.

FOREIGN PATENT DOCUMENTS

| | | |
|---|---|---|
| JP | 7-152239 | 6/1995 |
| JP | 8-179612 | 7/1996 |
| JP | 8-305149 | 11/1996 |
| JP | 2000-250298 | 9/2000 |
| JP | 2001-228693 | 8/2001 |
| JP | 2003-50502 | 2/2003 |
| JP | 2003-255684 | 9/2003 |
| JP | 2004-317592 | 11/2004 |
| JP | 2005-70357 | 3/2005 |
| WO | 2004/081673 A1 | 9/2004 |

* cited by examiner

*Primary Examiner*—Hoan Tran
(74) *Attorney, Agent, or Firm*—Nixon & Vanderhye P.C.

(57) ABSTRACT

A toner supply device controls at what position a joint receiving section stops, using a position detection sensor. By doing so, the rotation of a toner container is stopped at a position where a toner exit is above the boundary surface of toner. Therefore, in a developer supply device in which the toner container rotates, at what position the rotation of the toner container stops is controlled, so that members such a shutter properly operate and toner supply is stably carried out.

17 Claims, 21 Drawing Sheets

FIG. 17 (a)
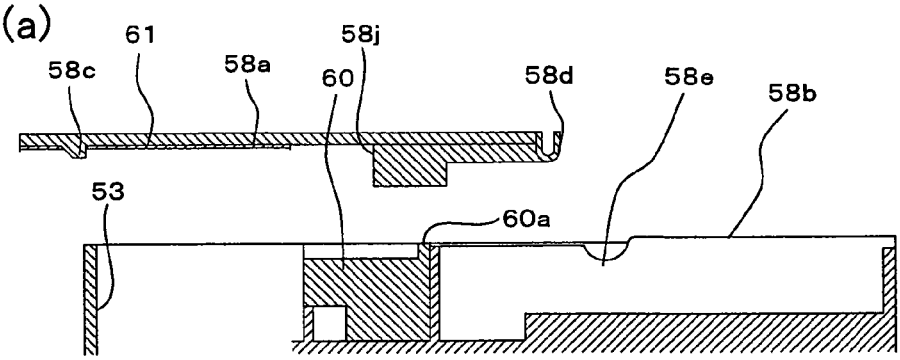
FIG. 17 (b)
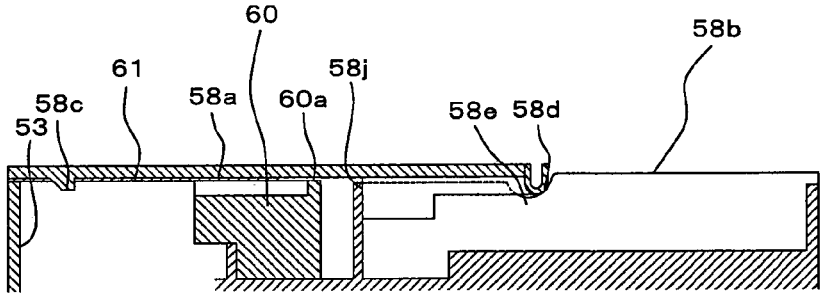
FIG. 17 (c)
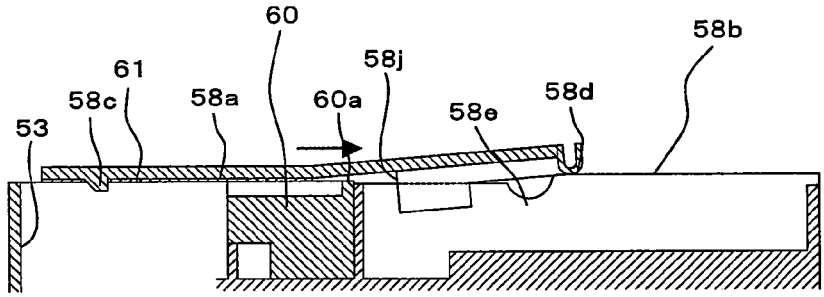
FIG. 17 (d)
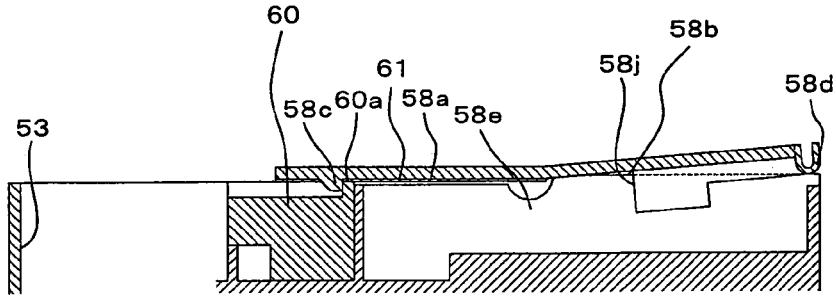
FIG. 17 (e)
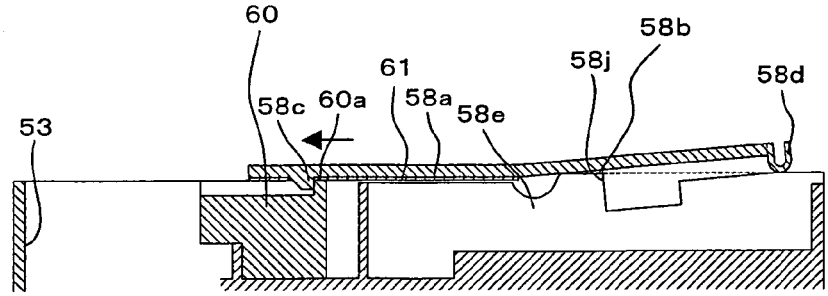
FIG. 17 (b)

INSIDE PRINTER
OUTSIDE PRINTER
HOPPER AREA
TONER SUPPLY DEVICE AREA 8
102
103
101
104
58
58a
58b
58d
58f
58g
58j

DEVELOPER SUPPLY DEVICE AND IMAGE FORMING APPARATUS INCLUDING THE SAME

This Nonprovisional application claims priority under 35 U.S.C. § 119(a) on Patent Application No. 2004/201143 filed in Japan on Jul. 7, 2004, the entire contents of which are hereby incorporated by reference.

FIELD OF THE INVENTION

The present invention relates to a developer supply device, for use in electrophotographic image formation, for supplying developer to a developing device, and an image forming apparatus including the developer supply device.

BACKGROUND OF THE INVENTION

To a developing device included in an image forming apparatus utilizing electrophotography, such as a photocopier, a facsimile machine, and a printer, a toner is supplied using a toner container (developer supply device) which is detachably provided to the image forming apparatus. Conventionally, for realization of a preferred supply of toner from the toner container to the developing device, various kinds of toner containers have been suggested.

For example, patent document 1 (Japanese Laid-Open Patent Application No. 2000-250298 (published on Sep. 14, 2000) discloses a toner container in which a supply opening (toner supply port) is formed through the bottom surface of the toner container (toner storing member). In this developer supply device, toner in the toner container is agitated by an agitator provided in the container, so that aggregation (coagulation of toner) is prevented. In the developer supply device, furthermore, a position where the agitator stops rotation is controlled so that the resistance arising on the occasion of rotating the agitator again is decreased.

However, the developer supply device of patent document 1 is not provided with a shutter for opening and closing the supply opening. For this reason, toner drops off through the supply opening at the time of detaching the developer supply device.

When the toner in the toner container runs out, the toner container is typically replaced with a new one or is refilled with toner. In such cases, the toner container is detached from the image forming apparatus or the developing device. In this connection, there are measures for facilitating this operation and preventing the toner from scattering around.

One of such measures is a seal on the opening (toner supply port) for supplying the toner.

Since the toner supply port of a new toner container is sealed with a seal, the toner does not scatter around through the toner supply port.

Meanwhile, in a case where the toner container is replaced with a new one after the toner runs out, an amount of toner remaining in the old toner container is scarce. For this reason, in such a case, it is often considered unnecessary to operate, for instance, a shutter for preventing the toner from scattering through the toner supply port. However, in many cases a few amount of toner remains inside the toner supply port. Since such toner scatters through the toner supply port, it is necessary to provide, for instance, a shutter for shutting the toner supply port.

The toner container is sometimes detached on the occasion of troubles such as device malfunction. That is, the toner container may be detached even if toner still amply remains therein. In such a case, the toner is likely to scatter at the time of detaching the toner container.

In order to prevent the aforesaid scattering of toner, most of the toner containers are equipped with a shutter mechanism by which the toner supply port is opened and closed.

Meanwhile, there is a type of toner containers in which the toner container is rotated for discharging toner from the toner container to the outside. Such a toner container is provided with a space where the toner discharged through the exit of the toner container is temporally stored. Then the toner discharged from the exit is supplied from the space to the toner supply port, on account of the rotation of the toner container.

However, the rotation of the toner container of the aforesaid type of toner container stops at an arbitrary position. In other words, at what position the rotation stops is not particularly determined. On this account, when the rotation of the toner container stops at a particular position, the shutter or the like for opening and closing the toner supply port may not properly operate.

Moreover, in the aforesaid type of toner container, toner flows into the space for temporally storing the toner, when the rotation of the toner container stops at a particular position. If a long period of time elapses while the toner remains in the space, the toner in the space coagulates and do not flow out. For instance, in a case where the rotation of the toner container stops while the exit for supplying toner from the toner container to the toner supply port is below the upper surface (boundary surface) of toner (i.e. the exit is immersed in the toner), the toner flows into the space through the exit, because of the weight and pressure of the toner. If a long period of time elapses while the toner remains in the space, the toner coagulates in the space and do not flow out therefrom, on account of a pressure due to the weight of the toner and a pressure generated when the toner flows (rushes) into the space. This induces such a problem that the toner is not stably supplied when the operation of supplying the toner is resumed.

SUMMARY OF THE INVENTION

The present invention was done to address the above-described problem, and the objective of the present invention is to provide (i) a developer supply device whose toner supply container rotates and in which members such as a shutter properly operate and toner supply is stably performed on account of the control of a position where the rotation of the toner container stops, and (ii) an image forming apparatus provided with the developer supply device.

To achieve this objective, the developer supply device of the present invention, which is detachably installed in an image forming apparatus and supplies developer to an outside of the developer supply device by rotating a cylindrical developer container containing the developer on an axis line of the developer container as a rotation axis, comprises: an exit in a recessed portion provided on an outer circumferential surface of the developer container; a support member, by surrounding at least a recessed portion forming region formed around the outer circumferential surface along a direction of rotation of the developer container so as to include an area where the recessed portion is provided, rotatably holding the developer container, and having a developer supply port for supplying, to the outside of the developer supply device, the developer ejected from the exit into the recessed portion; a scraping member, provided in the developer supply port so as to slide along the recessed portion forming region during rotation of the developer container, scraping the developer in the recessed portion by sliding along the recessed portion in the recessed portion forming region; a shutter provided in the support member, for opening and closing the developer supply port; and a position detection section stopping the developer container at a position where the exit is above a boundary surface of the developer.

According to this arrangement, the position detection section stops the rotation of the developer container, at a position where the exit is above the boundary surface of the developer. With this, when the developer container stops the rotation, the developer does not flow into the recessed portion from the exit. In other words, the exit is left open. On this account, even if the developer container is left without rotation for a long period of time, the toner in the concave portion does not coagulate. This prevents troubles caused by the developer in the concave portion, at the time of re-activation (restart the rotation of the developer container).

In this manner, according to the arrangement above, at what position the rotation of the developer container stops is controlled by the position detection section, so that the shutter properly operates. Also possible is prevention of coagulation of the developer in the recessed portion and the leakage of the developer through the developer supply port at the time of detaching or attaching the developer supply device. On this account, it is possible to prevent troubles such as poor supply of the developer and pollution on account of developer leakage from occurring, making it possible to stably and properly supply the developer.

BRIEF DESCRIPTION OF THE DRAWINGS

FIG. 8(*b*) is a cross sectional view showing a state where the toner ejecting sheet is away from the first recessed portion when the toner container in the state shown in FIG. 8(*a*) further rotates.

FIG. 9(*b*) is a cross sectional view showing the structure of the toner supply port and its peripheral area where the rotation of the toner supply device shown in FIG. 1(*a*) in one direction is restricted.

FIG. 9(*c*) is a cross sectional view showing the structure of the toner supply port and its peripheral area where the rotation of the toner supply device shown in FIG. 1(*a*) in the reverse direction is restricted.

FIG. 10(*b*) is a perspective view showing the toner supply port as viewed from the toner container side in the toner supply device shown in FIG. 1(*a*).

FIG. 11(*b*) is a perspective view showing the state of the shutter when detachment of the toner supply device shown in FIG. 1(*a*) from the printer is completed.

FIG. 12(*b*) is a perspective view showing the toner supply device in FIG. 12(*a*) from which some parts are detached.

FIG. 13(*b*) is a cross sectional view showing a state where the toner exit in the state shown in FIG. 13(*a*) is unsealed.

FIG. 14(*b*) is a cross sectional view showing a state where the toner ejecting sheet is placed in the first recessed portion when the toner container in the state shown in FIG. 14(*a*) rotates.

FIG. 17(*a*) is a cross sectional view showing a state where a shutter plate is separated from a shutter plate guide in the shutter included in the toner supply device shown in FIG. 1(*a*).

FIG. 17(*b*) is a cross sectional view showing a state where the shutter plate is closed in the shutter shown in FIG. 1(*a*).

FIG. 17(*c*) is a cross sectional view showing the shutter plate in the state shown in FIG. 17(*b*) being opened.

FIG. 17(*d*) is a cross sectional view showing a state where opening of the shutter plate in the state shown in FIG. 17(*c*) is completed.

FIG. 17(*e*) is a cross sectional view showing the shutter plate in the state shown in FIG. 17(*d*) being closed.

FIG. 18(*b*) is a cross sectional view showing a state where the installation proceeds from the state shown in FIG. 18(*a*), and a stopper releases stop of the shutter plate.

FIG. 18(*c*) is a cross sectional view showing a state where the installation proceeds from the state shown in FIG. 18(*b*), and opening of the shutter plate is started.

FIG. 18(*d*) is a cross sectional view showing a state where the installation proceeds from the state shown in FIG. 18(*c*), and the shutter plate is completely opened.

FIG. 18(*e*) is a cross sectional view showing a state at the start of detachment of the toner supply device from the printer.

FIG. 18(*f*) is a cross sectional view showing a state where the detachment proceeds from the state shown in FIG. 18(*e*), and closing of the shutter plate is started.

FIG. 18(*g*) is a cross sectional view showing a state where the detachment proceeds from the state shown in FIG. 18(*f*), and the shutter plate is completely closed.

FIG. 18(*h*) is a cross sectional view showing a state where, after the state shown in FIG. 18(*f*), the toner supply device is completely detached from the printer.

DESCRIPTION OF THE EMBODIMENTS

The following will describe an embodiment of the present invention. It is noted that the present invention is by no means limited to this embodiment. The present embodiment illustrates, as an example, a developer supply device such as a toner cartridge which is detachably attached to an electrophotographic image forming apparatus.

The developer supply device of the present invention prevents troubles such as poor developer supply and pollution on account of a leakage of a developer from occurring, making it possible to stably and properly supply the developer.

Figure 2:
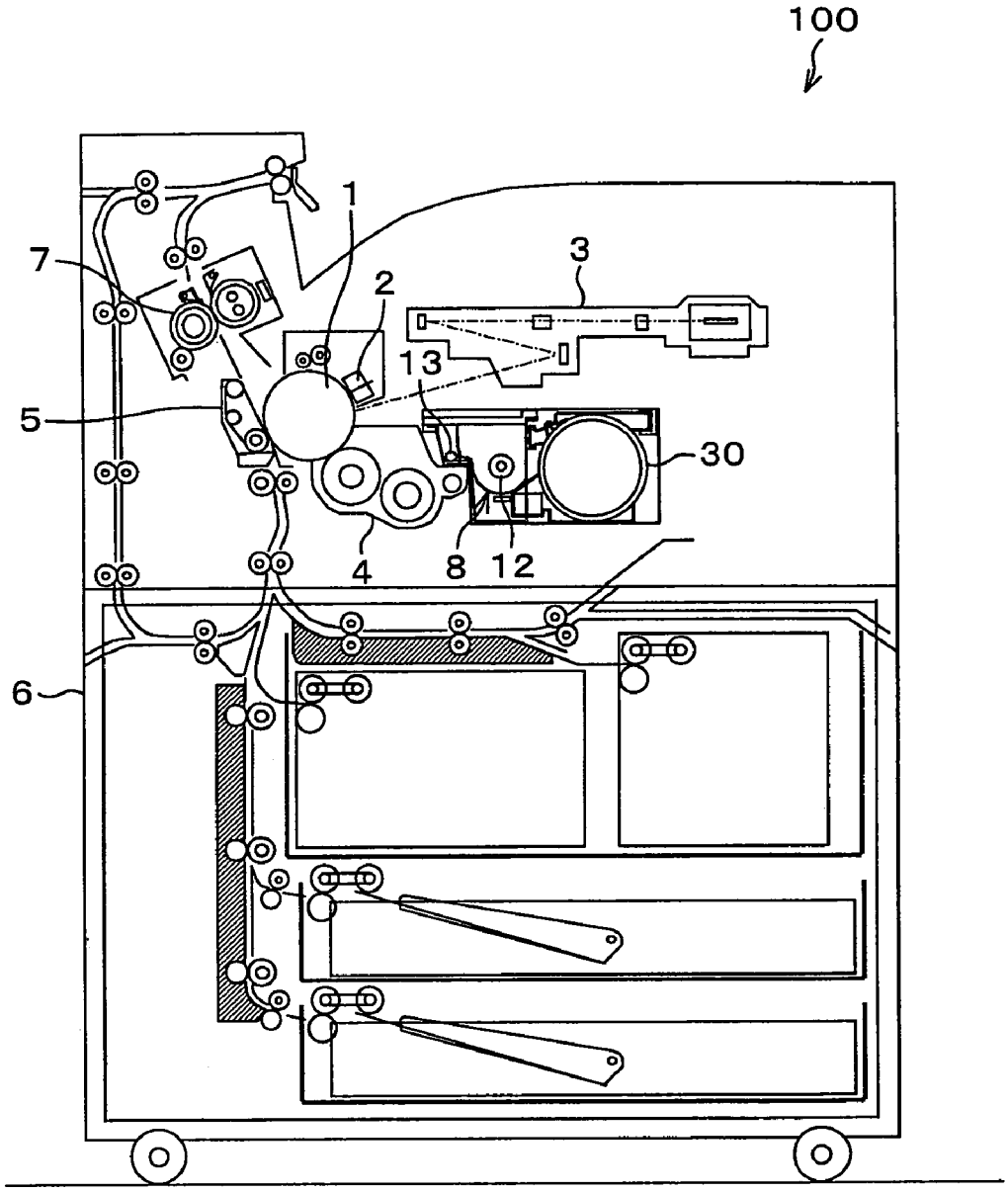
FIG. 2 is a plan view of an image forming apparatus including the toner supply device according to one embodiment of the present invention.

FIG. 2 is a plan view of a printer (image forming apparatus) 100 including a toner supply device (developer supply device) 30 according to the present embodiment. The toner supply device 30 is detachably provided in the electrophotographic printer 100 shown in FIG. 2. Through a hopper 8, the toner supply device 30 supplies toner (developer) to a developing device 4. The toner may be a two-component toner containing a carrier, or one-component toner containing no carrier. Further, the toner used in the toner supply device 30 may have a particle size as small as or less than 7 μm, so that the particles can easily aggregate themselves.

In addition to the toner supply device 30, the toner hopper 8, and the developing device 4, the printer 100 further includes a photosensitive drum 1, a charger 2, a laser exposing device 3, a transfer device 5, a feeder 6, and a fixing section 7, as illustrated in FIG. 2. In order to form image, the printer 100 as structured above electrifies the photosensitive drum 1 (electrostatic latent image carrier) with the charger 2, and forms an electrostatic latent image on the surface of the photosensitive drum 1 with the laser exposing device 3. Using the developing device 4, the electrostatic latent image formed on the photosensitive drum 1 is then developed into a toner image with the toner supplied from the toner supply device 30 through the hopper 8. With the transfer device 5, the toner image formed on the photosensitive drum 1 is transferred onto a recording sheet transported through the feeder 6. The transferred toner image on the recording sheet is fixed by the fixing section 7 before it is ejected out of the printer 100.

Figure 3:
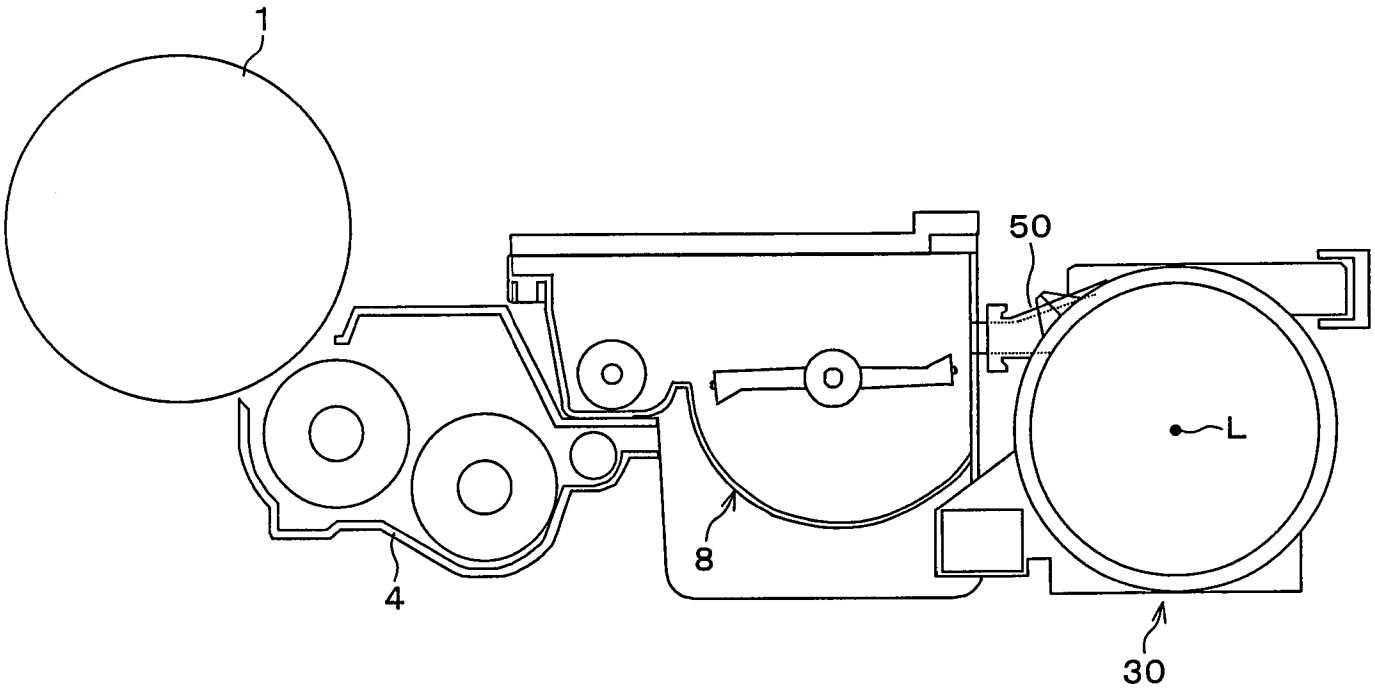
FIG. 3 is a plan view illustrating the toner supply device and a developing device.

FIG. 3 is a plan view illustrating the toner supply device 30 and the developing device 4 of the present embodiment as installed in the printer 100. The toner supply device 30, the toner hopper 8, and the developing device 4 are disposed in this order in a transport direction of toner in the printer 100, as shown in FIG. 3. With this construction, the toner ejected from the toner supply device 30 is stirred in the hopper 8 en route to the developing device 4. The developing device 4 supplies the toner to the photosensitive drum 1.

Figure 1:
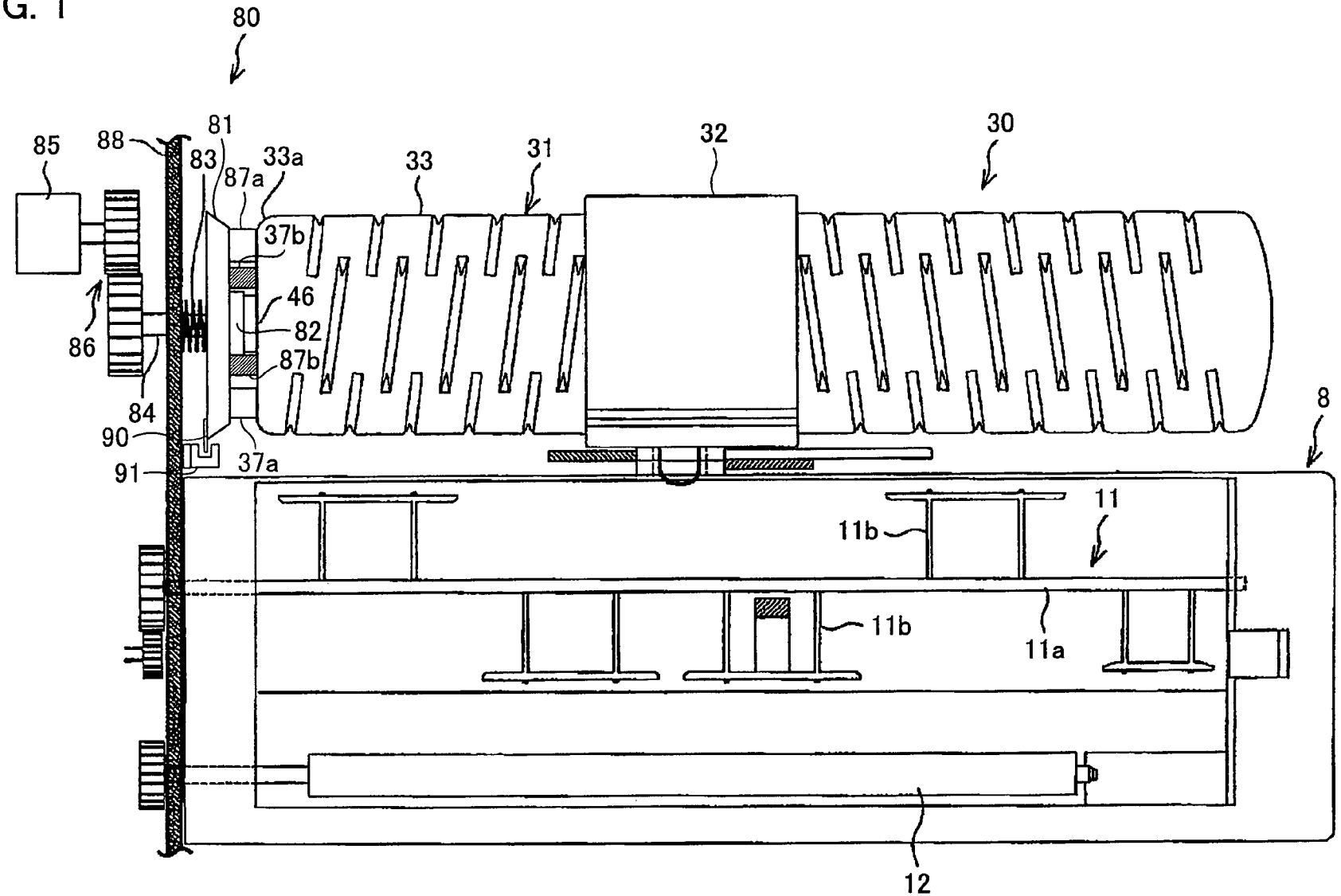
FIG. 1 is a top view illustrating a toner supply device and a main-body joint of an image forming apparatus of the present invention.
Figure 4:
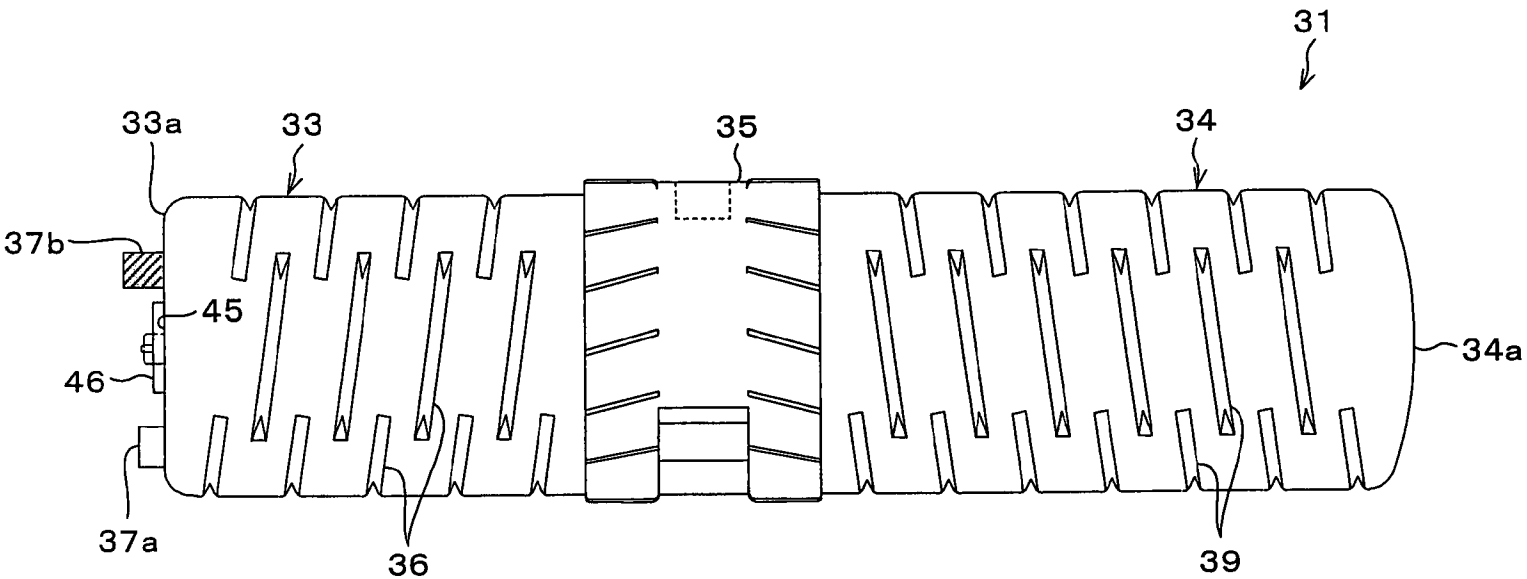
FIG. 4 is a side view of the toner supply device.
Figure 5:
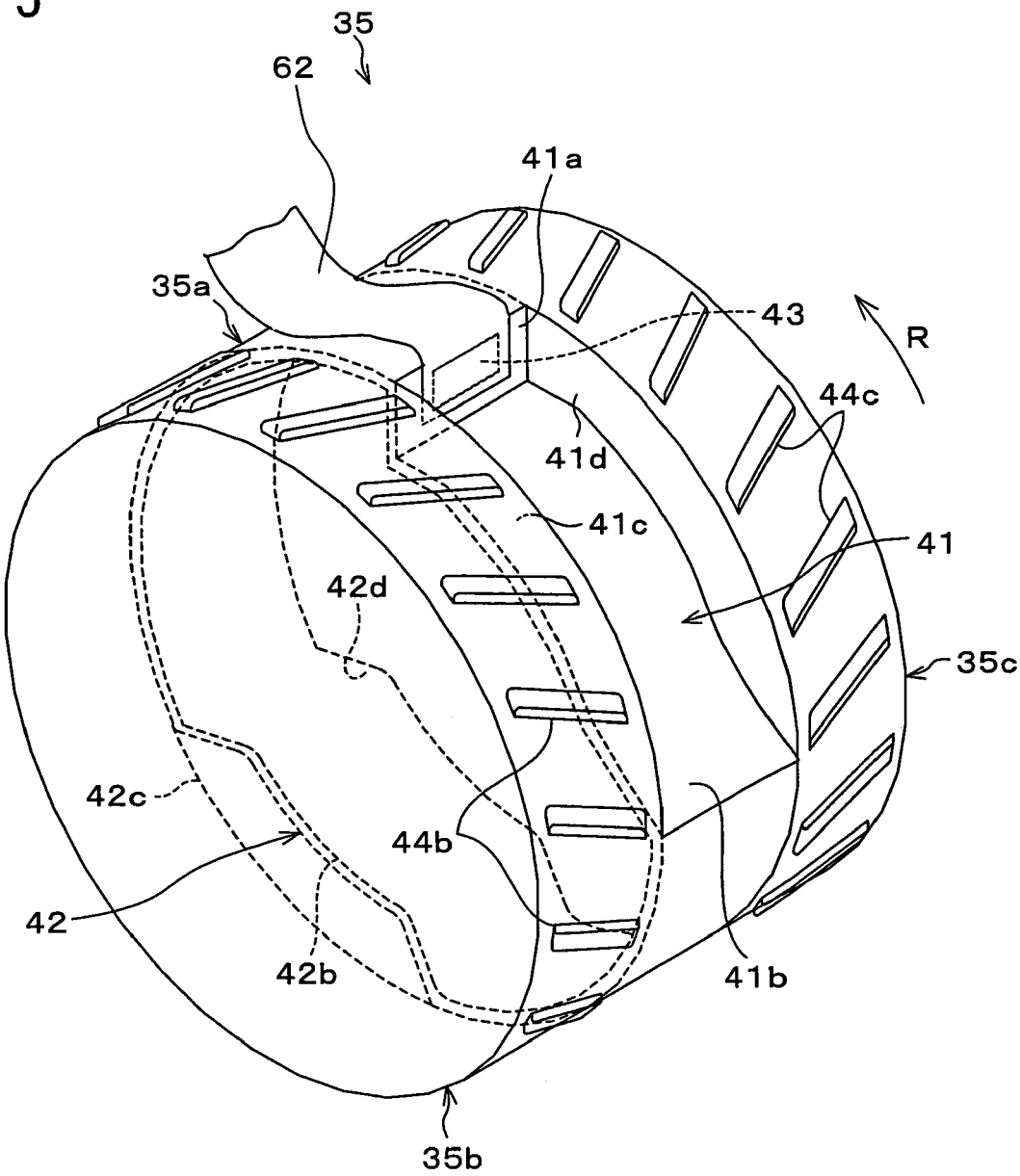
FIG. 5 is a perspective view showing a third container portion of the toner supply device shown in FIG. 4.

The following describes the toner supply device (developer supply device) 30. FIG. 1 is a top view illustrating the toner supply device 30 and a main-body joint (drive section) 80 of the printer (image forming apparatus) 100. As shown in this figure, the toner supply device 30 is basically made up of a cylindrical toner container (developer container) 31 storing toner (developer) and a support member 32 that rotatably supports the toner container 31. As shown in FIGS. 4 and 5, main components of the toner container 31 are a first container portion 33, a second container portion 34, and a third container portion 35. The third container portion 35 is provided with a first recessed portion 41 including a toner exit 43 for discharging the toner in the toner container 31 to the outside by the rotation of the toner container 31. The toner discharged to the first recessed portion 41 is transported to a below-mentioned toner supply port 50. In FIG. 1, the third container portion 35 provided substantially at the center of the toner container 31 is covered with the support member 32. Details of the toner supply device 30 will be described later.

The toner container 31 (more specifically, the first container portion 33) is connected to the main-body joint (drive section) 80 that includes members such as a drive source 85 used for rotating the toner container 31. The driving power of the drive source 85 is transmitted to the toner container 31 so that the toner container 31 is rotated. The connection between the toner container 31 and the main-body joint 80 (i.e. the transmission of the driving power from the drive source 85) is made by container-side connection portions 37*a* and 37*b* on the edge of the toner container 31 and drive-section-side connection portions 87*a* and 87*b* on a joint receiving section 81.

Figure 19:
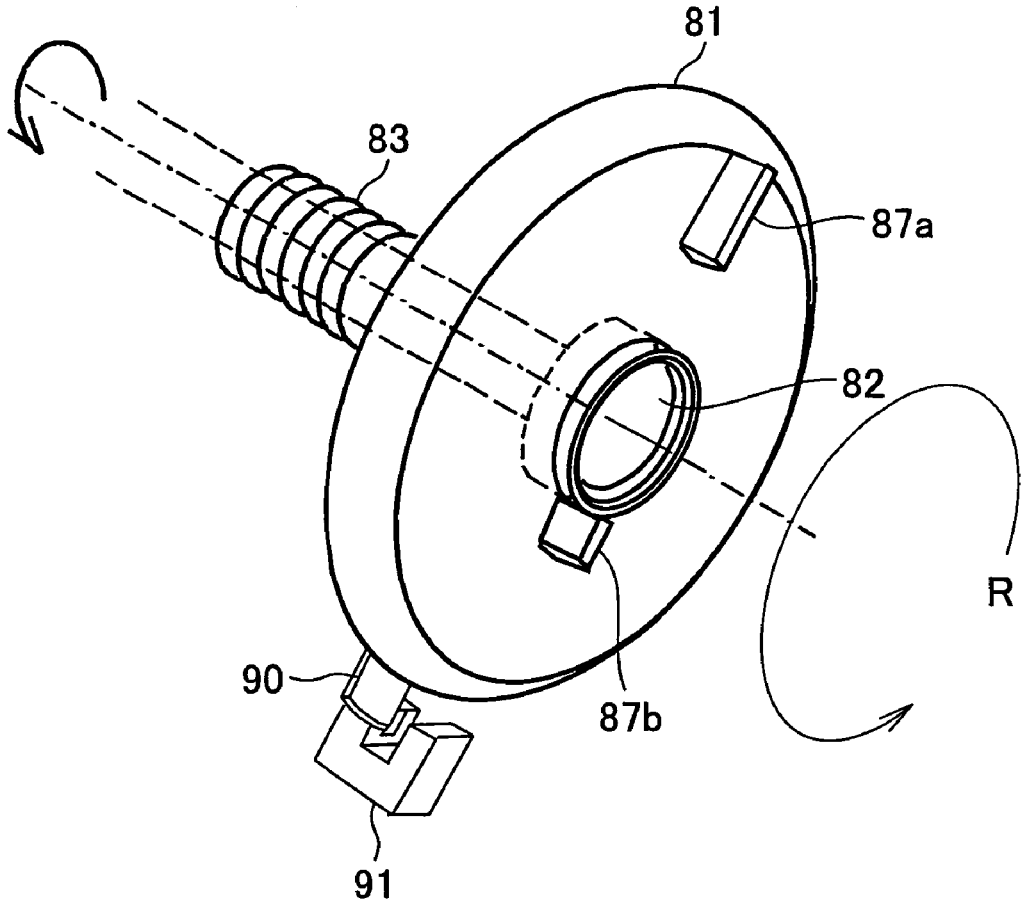
FIG. 19 is a top view illustrating a substantial part of the main-body joint shown in FIG. 1.

Referring to FIGS. 1 and 19, the main-body joint 80 is described. FIG. 1 is a top view illustrating the toner supply device 30 being connected to the main-body joint 80 of the printer 100, and also illustrating the toner hopper 8. FIG. 19 is a perspective view illustrating a substantial part of the main-body joint 80. In FIG. 1, the toner supply device 30 is installed in the printer 100. In inserting the toner supply device 30 to the printer 100, the first container portion 33 side of the toner supply device 30 is connected with the printer 100.

The main-body joint 80 includes the joint receiving section 81 coupled with the toner container 31, the drive source 85 for rotating the toner container 31, a speed reducer 86 such as a gear, a rotation axis 84 for transmitting the driving power from the drive source 85 to the joint receiving section 81, and a spring member 83 for adjusting the coupling of the toner container 31 and the joint receiving section 81. As the driving power of the drive source 85 such as a motor is transmitted to the joint receiving section 81 through the intermediary of the speed reducer 86 and the rotation axis 84, the joint receiving section 81 rotates. In response to this rotation of the joint receiving section 81, the toner container 31 coupled with the joint receiving section 81 rotates. The joint receiving section 81 is biased by the spring member 83 towards the toner container 31 side.

More specifically, the main-body 80 includes the disk-shaped joint receiving section 81 which is rotated by the driving power of the driver source 85 (e.g. motor) of the printer 100. This joint receiving section 81 is coupled with the toner container 31 of the toner supply device 30. To be more specific, the rotation of the joint receiving section 81 causes the drive-section-side connection portions 87*a* and 87*b* on the joint receiving section 81 to be in touch with and coupled with the container-side connection portions 37*a* and 37*b* on a bottom portion 33*a* of the first container portion 33 of the toner container 31. As a result of this, the toner container 31 and the main-body joint 80 are coupled with each other. That is, the container-side connection portions 37*a* and 37*b* and the drive-section-side connection portions 87*a* and 87*b* have contact surfaces, respectively. Each of these contact surfaces becomes in contact with a corresponding contact surface, so that the toner container 31 rotates. In this manner, the driving power of the main-body joint 80 is transmitted to the toner container 31.

At the center of the joint receiving section 81, an open-ended (hollow) lid storage section 82 which is larger in diameter than a lid 46 is provided. The lid 46 is inserted into the lid storage section 82, so that at least a part of the lid 46 is stored therein. That is, the joint receiving section 81 is provided with the concave lid-storage section 82 into which the lid 46 fits with almost no gaps therebetween. On this account, the power for rotating the toner container 31 is properly transmitted, even in a case where only one drive-section-side connection portion 87*a* is provided on the joint receiving section 81. The joint receiving section 81 is preferably made of a material with good mechanical properties, e.g. POM (polyacetal resin).

As shown in FIG. 1, the joint receiving section 81 is attached to the rotation axis 84 penetrating a cabinet 88 of the printer 100, in such a manner as to correspond to the center of rotation of the rotation axis 84. The rotation axis 84 between the cabinet 88 and the joint receiving section 81 is provided with the spring member 83 such as a compression coil spring. The spring member 83 is biased in a direction in which the joint receiving portion 81 steps away from the cabinet 88. Therefore, movement of the toner supply device 30 in a direction of installation is restricted by a restricting member (not shown), in such a manner that the toner supply device 30 presses the joint receiving portion 81.

For instance, when, at the time of installing the toner container 31 in the printer 100, the container-side portion 37*a* comes in contact with the drive-section-side connection portion 87*a*, the spring member 83 causes the joint receiving section 81 to move towards the cabinet 88, thereby causing the toner container 31 not to be coupled with the main-body joint 80 (joint receiving section 81). Note that, in this description, when the toner container 31 and the main-body joint 80 (joint receiving section 81) are coupled to each other, the driving power is transmittable from the drive source 85 to the toner container 31.

In the toner supply device 30 installed in the printer 100 as above, the driving power of the drive source 85 on the printer 100 side is transmitted to the joint receiving section 81 through the intermediary of the speed reducer 86 and the rotation axis 84. Then the rotation of the joint receiving section 81 is transmitted to the toner container 31 via the container-side connection portions 37*a* and 37*b* and the drive-section-side connection portions 87*a* and 87*b*, so that the toner container 31 rotates around the cylinder axis.

The joint receiving section 81 is provided with the drive-section-side connection portions 87*a* and 87*b* for the connection with the toner container 31 (container-side connection portions 37*a* and 37*b*). The distance from the center of the joint receiving section 81 to the drive-section-side connection portion 87*a* is different from the distance from the center to the portion 87*b*. In other words, the drive-section-side connection portions 87*a* and 87*b* are not on a single circle drawn around the center of the joint receiving section 81.

The container-side connection portions 37*a* and 37*b* on the toner container 31 side are provided in a similar manner as the driver-section-side connection portions 87*a* and 87*b*. On this account, the container-side connection portion 37*a* corresponds to and is coupled with the drive-section-side connection portion 87*a*, and the container-side connection portion 37*b* corresponds to and is coupled with the drive-section-side connection portion 87*b*. Therefore, there is only one pattern of connection between the toner container 31 and the joint receiving section 81, and the positional relation in terms of rotation between the toner container 31 and the joint receiving section 81 is always the same. It is therefore possible to control where the rotation of the toner container 31 is stopped, by detecting a rotational position of either the toner container 31 or the joint receiving section 81.

Now, a position detection sensor (position detection section) 91 which is a characteristic feature of the printer 100 of the present embodiment will be described. The position detection sensor 91 stops the rotation of the toner container 31 while, for instance, a position of the toner container 31 is in the range between the position shown in FIG. 14(*a*) and the position shown in the FIG. 13(*a*). In other words, the rotation of the toner container 31 is stopped while the toner exit 43 is above the boundary surface of the toner 27.

A method of controlling at what position the rotation of the toner container 31 stops, by means of the position detection sensor 91, will be described.

As shown in FIGS. 1 and 19, in the present embodiment the joint receiving section 81 is provided with a detection target section 90 protruding outwards from the periphery of the joint receiving section 81. A position of the detection target section 90 is detected by the position detection sensor 91. More specifically, the rotation of the joint receiving section 81 causes the detection target section 90 to rotate. On this account, a position of the rotating joint receiving section 81 can be detected in such a manner that the position detection sensor 91 in the printer 100 (in FIG. 1, on the side surface of the cabinet 88) detects the detection target section 90. As described above, the joint receiving section 81 and the toner container 31 are coupled with each other only in one position, on account of the connection portions (37*a*, 37*b*, 87*a*, and 87*b*). Therefore, it is possible to predict the rotational position of the toner container 31 from the rotational position of the joint receiving section 81 or the toner container 31. On this account, when a position where the detection target section 90 is detected by the position detection sensor 91 is set at a position where the toner exit 43 is above the boundary surface of the toner 27, it is possible to control the toner container 31 to stop the rotation at that position detected by the position detection sensor 91. With this, even if the toner container 31 is left at that position for a long period of time, the toner 27 does not enter the first recessed portion 41 through the toner exit 43. It is therefore possible to prevent the toner 27 from coagulating in the first recessed portion 41, and hence even if the toner supplying operation is resumed after a long period of time, the toner is properly supplied. The toner supply is therefore always stably carried out. Note that, although, in the foregoing example, at what position the rotation of the toner container 31 is stopped is controlled in line with the detection of the detection target section 90 by the position detection sensor 91, this example by no means limit the present invention. There is an alternative arrangement described later, in which a coupling pattern between one or more container-side connection portion(s) 37*a* (37*b*) and one or more drive-section-side connection portion(s) 87*a* (87*b*) is restricted to one, and the position detection sensor 91 detects a position of either the container-side connection portion(s) 37*a* (37*b*) or the drive-section-side connection portion(s) 87*a* (87*b*), so that at what position the rotating toner container 31 is stopped is controlled. That is, at what position the rotation of the toner container 31 is stopped can be controlled simply by detecting the rotational position of either the main-body joint 80 or the tone container 31.

A position of the toner exit 43 when the rotation of the toner container 31 is stopped is not particularly limited, as long as the position is above the boundary surface of the toner 27. It is, however, preferable that the toner exit 43 be stopped at the uppermost portion of the toner container 31 (i.e. at an intersection P (see FIG. 14(*a*)) at which a line vertically extending upward from the boundary surface of the toner 27 (i.e. a line vertically extending upward from the center of the toner container 31) intersects with the toner container 31. The intersection P is on the highest portion (uppermost portion) of the toner container 31. Therefore the boundary surface of the toner 27 never be higher than the intersection P. On this account, stable toner supply is ensured, on condition that the rotating toner container is controlled so that the toner exit 43 always stops at the intersection P.

Figure 13:
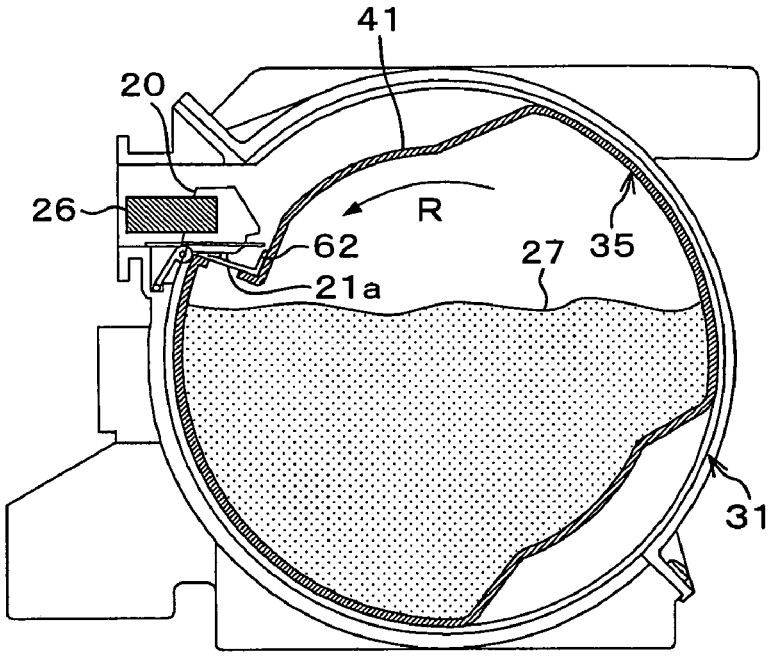
FIG. 13(*a*) illustrates the operation when toner is supplied from the toner supply device shown in FIG. 1(*a*), and is a cross sectional view showing a state where a toner exit is sealed with a seal.
Figure 13:
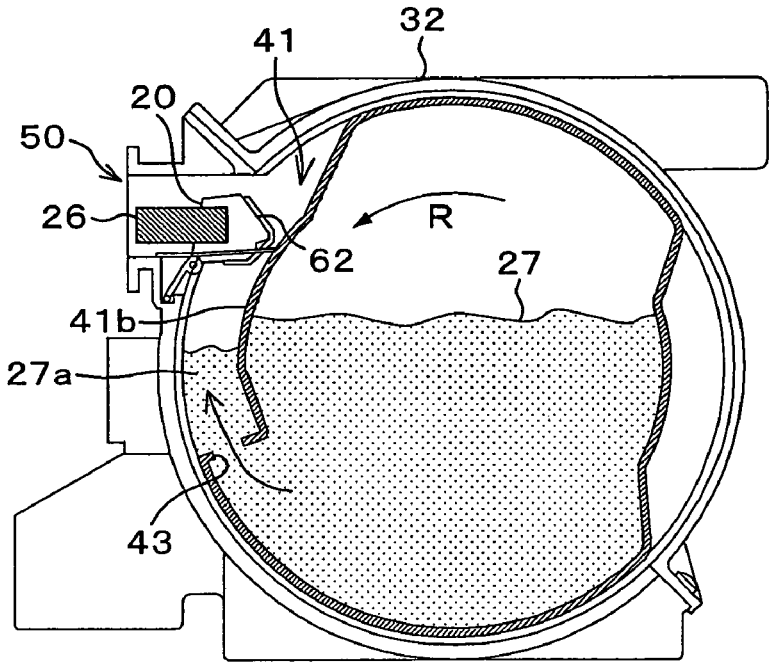

In a case where the rotation of the toner container 31 stops at an arbitrary position as in the conventional case, the rotation of the toner container 31 may stop at, for instance, the position shown in FIG. 13(*b*). In this case, since the toner exit 43 is below the boundary surface of the toner 27, the toner 27 in the toner container 31 flows into the first recessed portion 41 via the toner exit 43, on account of the weight and pressure of the toner 27. Furthermore, since a pressure is applied to the first recessed portion 41 on account of the weight of the toner 27 and on the occasion of the inflow of the toner 27 into the first recessed portion 41, toner 27*a* in the first recessed portion 41 coagulates and do not flow out therefrom. Moreover, the toner exit 43 is sealed with the toner 27, causing the first recessed portion 41 to be a closed space. The toner 27*a* in the first recessed portion 41 also coagulates if the toner 27*a* in the aforesaid state is left for a long period of time. The coagulation of the toner 27*a* obstructs the next toner supply. Also, once the toner coagulates, the toner 27*a* does not flow from the first recessed portion 41 to the toner supply port 53 even if the toner supply port 53 is closed by the below-mentioned shutter 58. On this account, the toner 27*a* leaks from the first recessed portion 41, at the time of detaching the toner supply device 30. More specifically, at the time of supplying the toner 27, while the toner exit 43 is rotating, the shutter 58 remains stationary because the shutter 58 is independent of the toner exit 43. Therefore, if the rotation of the toner container 31 stops while the toner exit 43 is below the boundary surface of the toner 27, the toner 27 flows into the first recessed portion 41 and coagulates. As a result, the toner 27*a* hardly flows out even if the toner container 31 rotates and reaches a position where the toner 27*a* in the first recessed portion 41 is discharged. The toner 27*a* therefore remains in the toner supply port 53. This obstructs the movement of the shutter 58, thereby inducing such a trouble that the toner leaks out as the shutter 58 does not properly operate. In this manner, in the conventional developer supply device, the shutter 58 may not properly operate.

In the present embodiment, each of the container-side connection portions 37*a* and 37*b* and the drive-section-side connection portions 87*a* and 87*b* has a convex shape. Also, the container-side connection portion 37*a* is coupled (connected) with the drive-section-side connection portion 87*a*, and the container-side connection portion 37*b* is coupled (connected) with the drive-section-side connection portion 87*b*. In other words, the container-side connection portions 37*a* and 37*b* can be one-to-one coupled (connected) with the respective drive-section-side connection portions 87*a* and 87*b*, but the container-side connection portion 37*a* cannot be coupled (connected) with the drive-section-side connection portion 87*b*. As these connection portions becomes in touch with one another and coupled with one another, the toner container 31 is coupled with the joint receiving section 81, so that the driving power of the drive source 85 is transmitted to the toner container 31, causing the toner container 31 to rotate.

According to FIG. 1, each of the container-side connection portions 37*a* and 37*b* and the drive-section-side connection portions 87*a* and 87*b* has a convex shape. However, the shape of each connection portion may be optionally determined, on condition that the driving power can be transmitted from the drive source 85 to the toner container 31. For instance, convex connection portions on one side may be coupled with concave connection portions on the other side. However, in a case where a plurality of connection portions are provided on each of the container side and the drive section side, it is necessary to form the connection portions in such a manner that the container-side connection portions 37 one-to-one correspond to the drive-section-side connection portions 87, respectively. This uniquely determines the connection state (coupling pattern) of the toner container 31 and the joint receiving section 81.

As described above, in the toner supply device 30 of the present embodiment, the rotating toner container 31 stops at a position where the toner exit 43 is above the boundary surface of the toner 27, on account of the position detection sensor 91. On this account, when the rotation of the toner container 31 stops, the toner does not flow from the toner container 31 into the first recessed portion 41. This prevents the toner 27*a* from coagulating in the first recessed portion 41, even if the toner container 31 stops the rotation for a long period of time.

Also, the shutter 58 can open the toner supply port 53 in a case where the toner supply device 30 is installed in the printer 100, while the shutter 58 can close the toner supply port 53 in a case where the toner supply device 30 is detached from the printer 100. Therefore, when the toner supply device 30 in which the toner container 31 still contains the toner 27*a* is detached from the printer 100, the toner supply port 50 is closed. On this account, it is possible to prevent the toner from leaking through the toner supply port 50, at the time of detaching the toner supply device 30.

In addition, as described above, while the rotation stops, the toner exit 43 is above the boundary surface of the toner 27. On this account, the toner 27 in the toner container 31 does not flow into the first recessed portion 41 through the toner exit 43. Also, when the toner supply device 30 is detached, the rotation of the toner container 31 is stopped. Therefore the toner 27*a* discharged to the first recessed portion 41 does not leak through the toner supply port 53, when the toner supply device 30 is detached and the toner supply port 50 is closed. In short, the shutter 58 always properly operates.

In the meanwhile, since at what position the toner container stops the rotation is not particularly determined in the conventional supply device, the rotation of the developer container may stop at a position where the toner exit 43 is below the boundary surface of the toner 27. In this state, as described above, the toner 27 flows into the first recessed portion 41 through the toner exit 43, on account of the weight and pressure of the toner 27 in the toner container 31. If the toner supply device 30 in this state is left for a long period of time, unused toner 27*a* coagulates in the first recessed portion 41. The coagulated toner imposes a heavy load on the toner supply device 30 at the time of reactivating the device. This may bring about troubles in the shutter mechanism and decrease of image quality on account of, for instance, short supply of the developer.

As described above, according to the present embodiment, at what position the toner container 31 stops the rotation is controlled using the position detection sensor 91, so that the shutter 58 properly operates. Moreover, it is possible to prevent the toner 27*a* from coagulating in the first recessed portion 41, and to prevent the toner from leaking through the toner supply port 50, at the time of detaching the toner supply device 30. On this account, it is possible to prevent troubles such as toner supply failure and pollution due to toner leakage from occurring, thereby making it possible to stably supply toner.

In addition to the above, in the toner supply device 30 of the present embodiment, the main-body joint 80 that transmits the rotational driving power to the toner container 31 is coupled with the toner container 31, by the drive-section-side connection portions 87*a* and 87*b* on the main-body joint 80 and the container-side connection portion 37*a* and 37*b* on the toner container 31. Moreover, the drive-section-side connection portions 87*a* and 87*b* and the container-side connection portions 37*a* and 37*b* are coupled with one another, in a single coupling pattern.

That is to say, a positional relationship (connection state) between the connection portions is uniquely determined, and the toner container 31 rotates with this positional relationship being unchanged. For this reason, at what position the rotation of the toner container 31 stops can be controlled either from the main-body joint 80 side or from the toner container 31 side.

In the toner supply device 30 of the present embodiment, a position where the main-body joint 80 (joint receiving section 81) stops the rotation is controlled using the position detection sensor 91 so that the toner container 31 stops the rotation at a position where the toner exit 43 is above the boundary surface of the toner 27.

On this account, it is unnecessary to provide, in the toner container 31, a member for controlling at what position the rotation of the toner container 31 stops. Therefore, especially in a case of a disposable toner container 31 (or the toner supply device 30), at what position the rotation stops can be controlled from the main-body joint 80 side. It is therefore unnecessary to provide, in the toner container 31, a member for controlling at what position the rotation stops. This makes it possible to reduce costs for manufacturing the disposable toner container 31 (toner supply device 30).

To put it another way, when the toner container 31 runs out toner, either the toner supply device 30 is replaced with a new one or the toner container 31 is refilled with toner. In short, the toner supply device 30 is disposable in some cases. On this account, it is preferable that at what position the toner container 31 stops the rotation be preferably controlled from the main-body joint 80 side. That is, as shown in FIG. 1, it is preferable that the position detection sensor 90 and the detection target section 91 be provided on the main-body joint 80 side (or on the printer 100 side). On this account, it is unnecessary to provide the position detection sensor 90 and the detection target section 91 in the disposable toner supply 30, making it possible to reduce costs for manufacturing the toner supply device 30.

In the toner supply device 30, the main-body joint 80 is coupled with the toner container 31 by a plurality of (two in FIG. 1) drive-section-side connection portions 87*a* and 87*b* and a plurality of (two in FIG. 1) container-side connection portions 37*a* and 37*b*. Also, as described above, these connection portions are coupled with one another only in one coupling pattern. With these connection portions, the driving power is surely transmitted from the main-body joint 80 to the toner container 31, so that the rotation of the toner container 31 is stably performed.

As an alternative to the above, in the toner supply device 30, the main-body joint 80 is coupled with the toner container 31 by a pair of connection portions, i.e. a drive-section-side connection portion 87*a* and a container-side connection portion 37*a*. As described above, a positional relationship (connection state) between the connection portions is uniquely determined (i.e. there is only one coupling pattern). This arrangement simplifies the arrangement of the connection portions for coupling the main-body joint 80 with the toner container 31.

For instance, in a case where each of the drive-section-side connection portions 87*a* and 87*b* and the container-side connection portions 37*a* and 37*b* is a rib, a contact surface (coupling surface) at which a rib is coupled with another one is formed on each rib. This allows the toner container 31 to rotate, with the contact surfaces of the corresponding ribs being coupled with one another. Since the ribs are one-to-one coupled with one another, it is possible to control at what position the toner container 31 stops the rotation, by detecting a position of one of those ribs (the drive-section-side connection portions 87*a* and 87*b* or the container-side connection portions 37*a* and 37*b*).

In the present embodiment, at what position the joint receiving section 81 stops the rotation is controlled using the position detection sensor 91 fixed to the cabinet 88 of the printer 100. Moreover, on account of this control, the rotation of the toner container 31 stops at a position where the toner exit 43 is above the boundary surface of the toner 27. That is, in the present embodiment, at what position the rotation of the toner container 31 stops is controlled from the drive section side from which the driving power is transmitted to the toner container 31.

Figure 22:
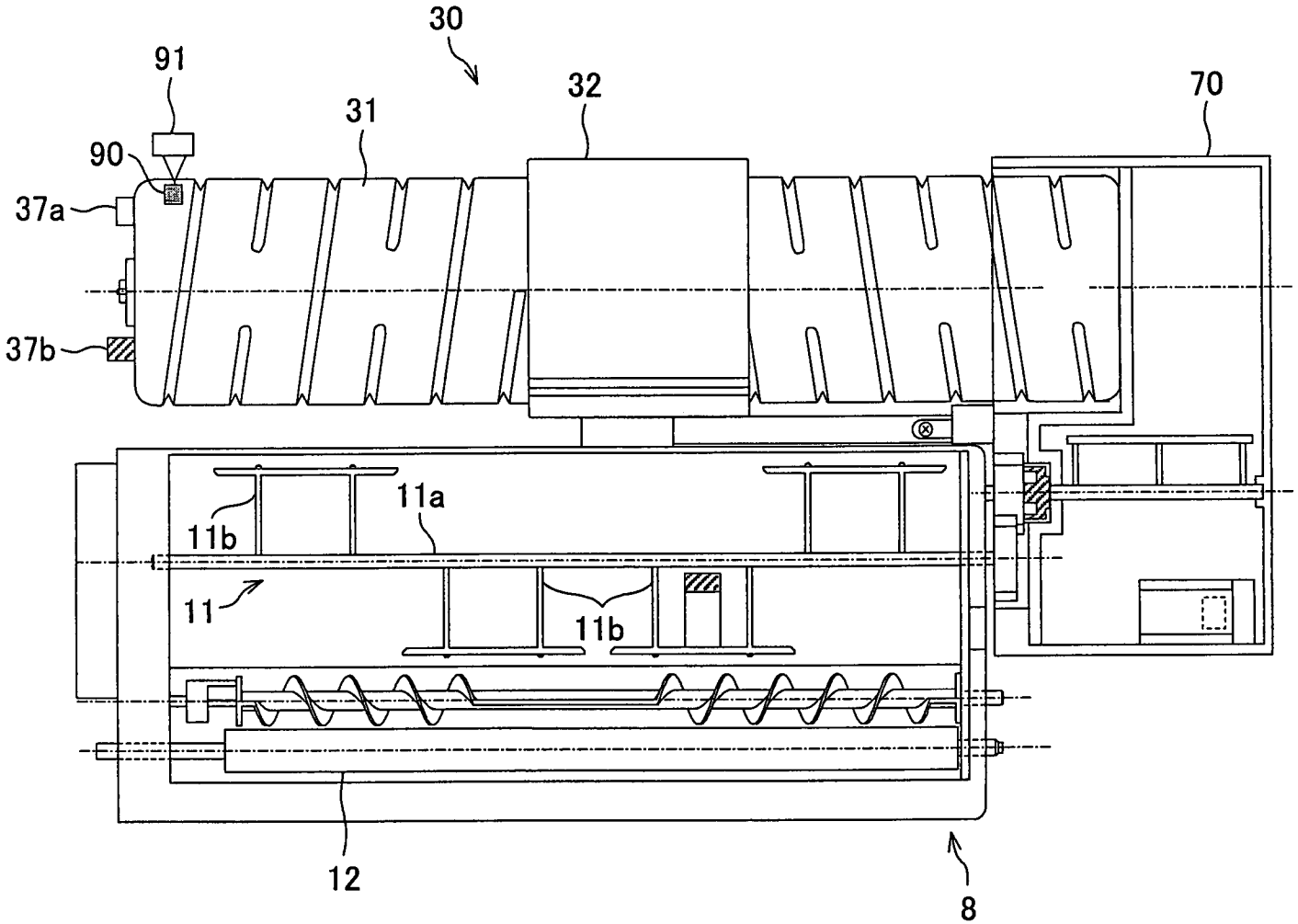
FIG. 22 is a top view illustrating the toner supply device that controls, by a reflecting tape on the tone storage, a position where the rotation of the toner container stops.

However, at what position the rotation of the toner container 31 stops may be controlled from the toner container 31 side. For instance, as shown in FIG. 22, a reflecting tape as the detection target section 90 detected by the position detection sensor 91 is provided on the toner container 31, and a position of the tape is detected by a reflective sensor as the position detection sensor 91, so that at what position the rotation stops is controlled. It is noted that a position of the reflective sensor may be optionally determined, on condition that the reflecting tape on the toner container 31 is detectable.

Figure 20:
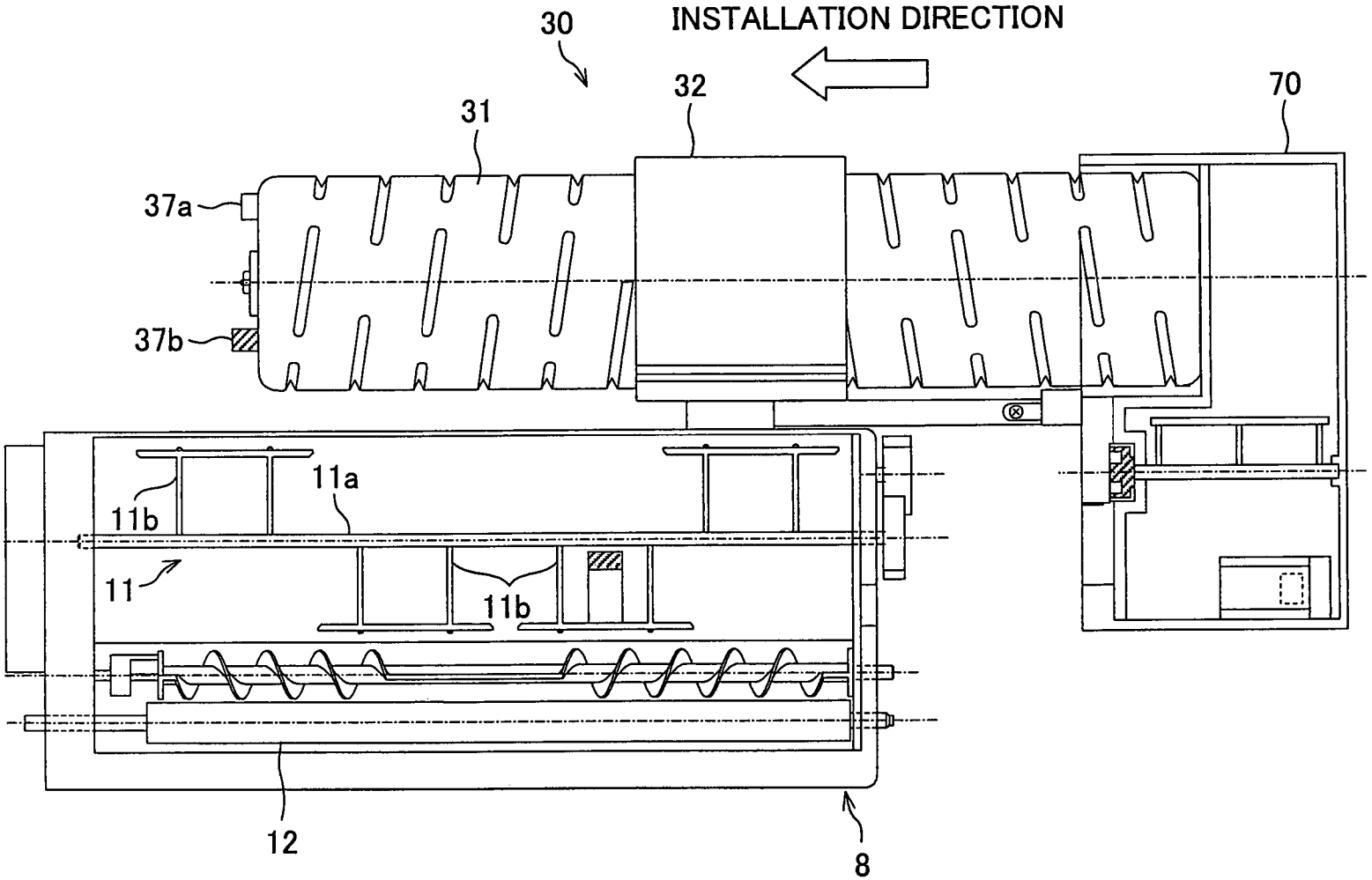
FIG. 20 is a top view illustrating how the toner supply device is inserted into the main body of the image forming apparatus.
Figure 21:
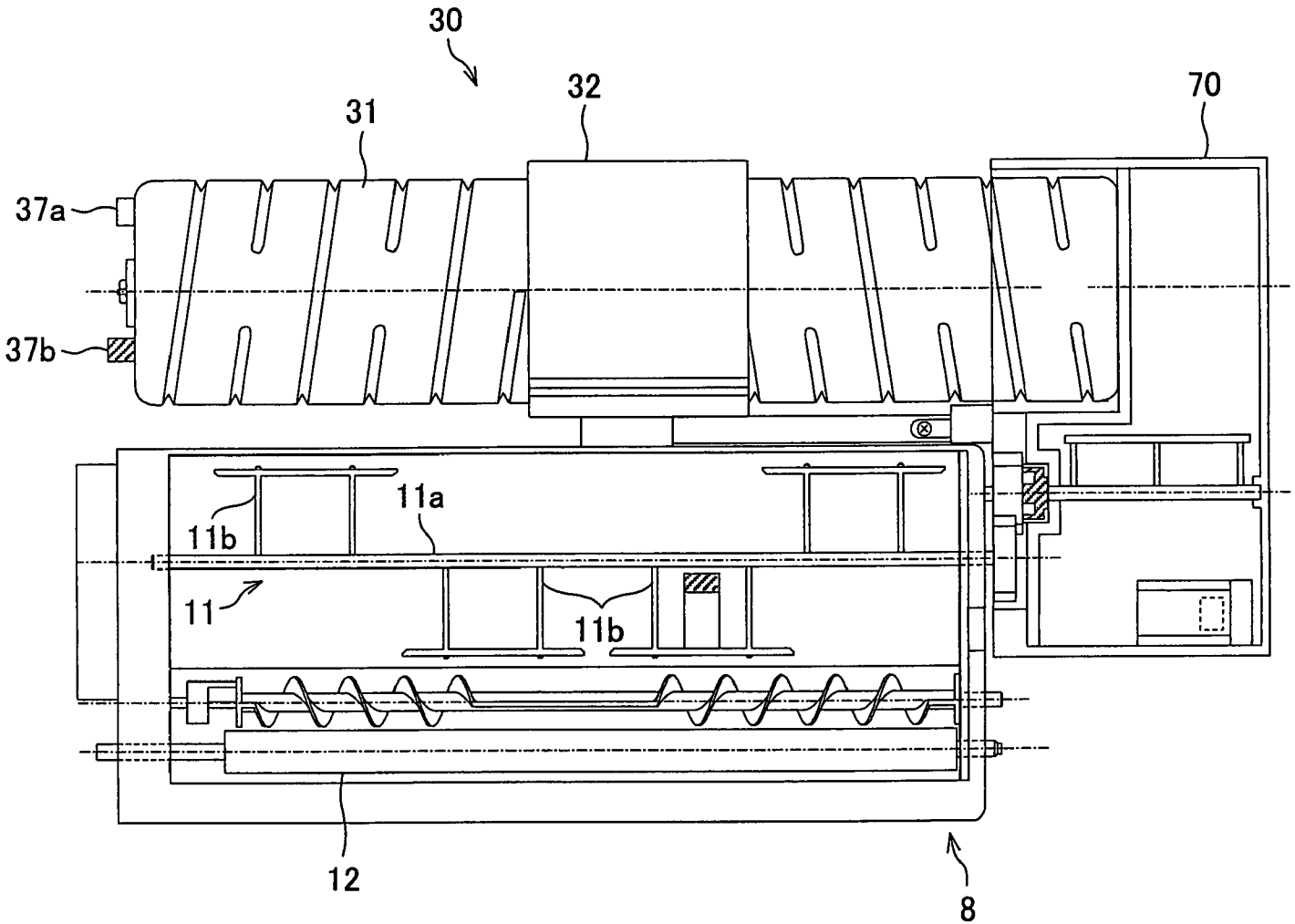
FIG. 21 is a top view showing that, after the state shown in FIG. 20, how the toner supply device is inserted into the main body of the image forming apparatus.

As illustrates in FIGS. 20 and 21, the toner supply device 30 is installed in the direction indicated in FIG. 20, in such a way as to come alongside the toner hopper 8 in the printer 100. Also as FIGS. 20 and 21 illustrates, a toner recovery container 70 may be provided on an end of the toner container 31 on the second container portion 34 side (see FIG. 4). In other words, the toner recovery container 70 may be provided on an end opposite to an end at which the container-side connection portions 37*a* and 37*b* are provided. This toner recovery container 70 is used for recovering toner after developing an electrostatic latent image on the photosensitive drum 1 and forming a toner image. Moreover, the toner recovered by the toner recovery container 70 may be transported to the toner container 31 so as to be recycled. It is noted that the toner recovery container 70 is not shown in the figures other than FIGS. 20-22.

A conventional toner supply device detects an amount of toner in a toner hopper, using a sensor. When the amount of the toner becomes not more than a predetermined amount, the sensor outputs a toner supply signal. In response to this signal, a motor causes a toner container to rotate, so that the toner is supplied to the toner hopper through a toner supply port of the toner supply device. Once the amount of the toner in the toner hopper reaches the predetermined amount, the sensor outputs a toner supply stop signal. In response to this, the motor stops and the rotation of the toner container also stops. In this manner, at what position the rotation of the toner container stops is not particularly determined in the conventional toner supply device. On this account, troubles such as poor supply of the developer and pollution on account of developer leakage may occur because of the position at which the rotation of the toner container stops, thereby preventing the developer from being stably and suitably supplied.

On the contrary, in the toner supply device 30 of the present embodiment, in addition to the aforesaid detection of an amount of toner, at what position the rotation of the toner container 31 stops is controlled using the position detection sensor 91, after outputting the toner supply stop signal. This prevents troubles such as poor supply of the developer and pollution on account of developer leakage from occurring, making it possible to stably and properly supply the developer.

The following will more specifically describe the toner supply device 30.

FIG. 1(*a*) and FIG. 1(*b*) are perspective views of the toner supply device 30. As illustrated in FIG. 1(*a*) and FIG. 1(*b*), the toner supply device 30 includes a toner container (developer container) 31, and a support member 32 for rotatably supporting the toner container 31, enabling the toner container 31 to rotate on a cylinder axis (axis line) L, as a rotation axis. The support member 32 includes a shutter 58 for opening or closing an opening 53.

Figure 12:
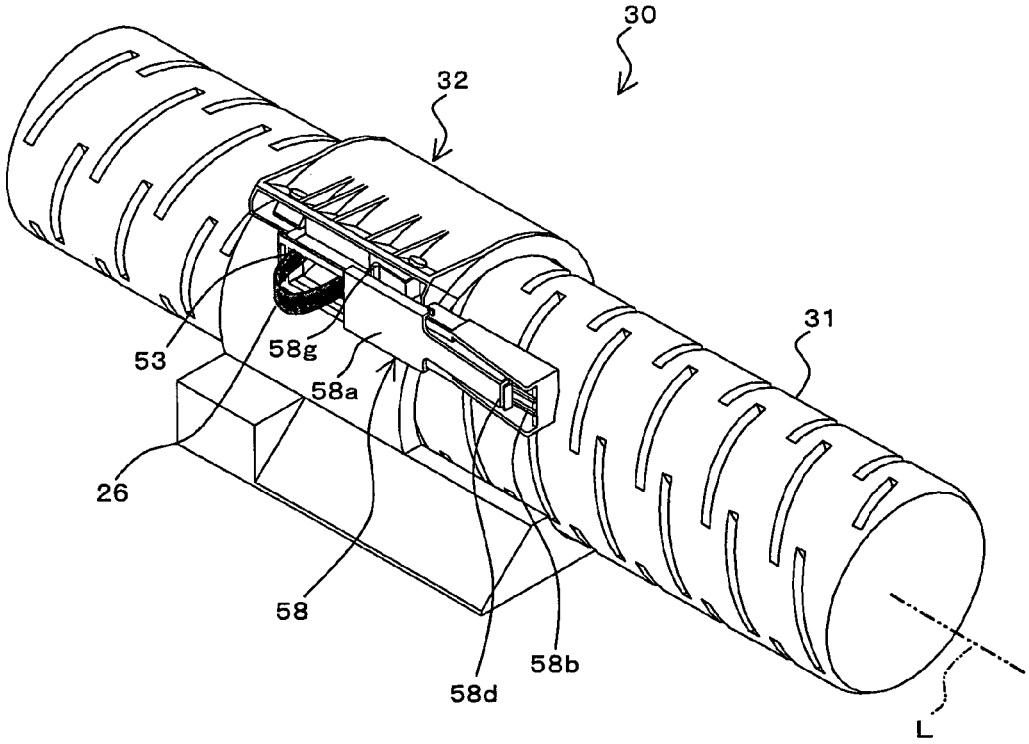
FIG. 12(*a*) is a perspective view showing an embodiment of the toner supply device.
Figure 12:
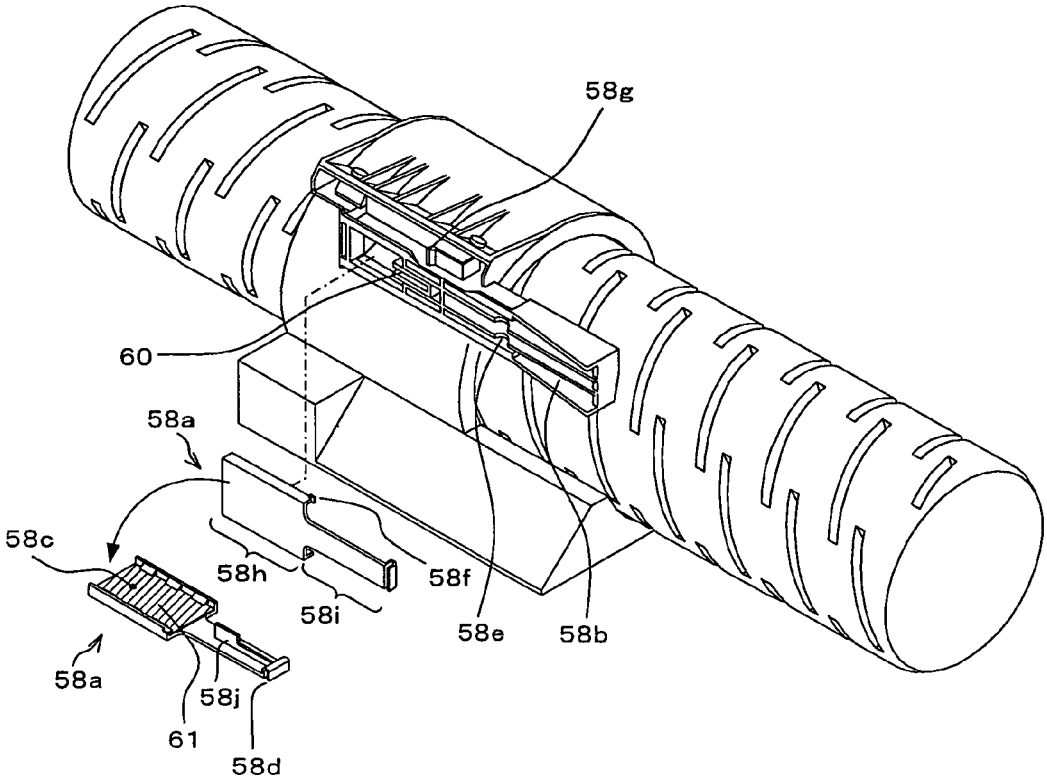

As illustrated in FIG. 12(*a*), the shutter 58 includes two main parts: a shutter plate (plate part) 58*a* and a shutter plate guide (plate guide) 58*b*. The opening 53 is provided in the shutter plate guide 58*b* of the shutter 58' Through the opening 53, toner is ejected into the toner hopper 8 side.

As illustrated in FIG. 12(*b*), the shutter plate 58*a* includes an opening covering portion 58*h* and a slider portion 58*i*. The opening covering portion 58*h* is provided to cover the opening 53 of a substantially rectangular shape. The slider portion 58*i*, smaller in width than a portion (the opening covering portion 58*h*) covering the opening 53, slides along the shutter plate guide 58*b*. Further, the opening covering portion 58*h* on the edge closer to the slider portion 58*i* has a locking pawl 58*f*. Further, the shutter plate 58*a* on the end of the slider portion 58*i* (i.e., the end of the slider portion 58*i* in a direction of movement of the shutter plate 58*a*) has an elastic end portion 58*d* formed of an elastic member. The shutter plate 58*a* at the elastic end portion 58*d* has a U-shape at cross section, in the direction of movement. Further, the shutter plate 58*a* on the surface ("back surface" hereinafter) of the opening covering portion 58*h* facing the shutter plate guide 58*b* has a projection 58*c*. The back surface of the opening covering portion 58*h* also has a felt (sliding member) 61 bonded thereto, except for portions provided with the projection 58*c*. The shutter plate 58*a* on the back surface of the slider portion 58*i* has a plate projection 58*j*. The plate projection 58*j* stands substantially perpendicular to the back surface, and extends in a direction of movement (open/close) of the shutter plate 58*a*.

The shutter guide 58*b* has a stopper 58*g*, and a notch 58*e* (recessed portion) formed on the surface of the shutter guide 58*b* facing the shutter plate 58*a*. The notch 58*e* is so formed that it fits the elastic end portion 58*d* when the shutter plate 58*a* is closed. The stopper 58*g* is formed of an elastic member and serves to stop the shutter plate 58*a*. That is, the locking pawl 58*f* provided on the shutter plate 58*a* stops on an end of the stopper 58*g* when the shutter plate 58*a* is in the closed position, preventing the shutter plate 58*a* from being opened accidentally.

The shutter plate guide 58*b* of the shutter 58 has a stopping member 60. The stopping member 60 moves into the opening 53 by interlocking with the shutter plate 58*a* being closed, and thereby pushes a scraper 20 (scraping member) into a recessed portion and restricts the rotation of the toner container 31. The scraper 20 is provided to scrape the toner supplied from the toner container 31. The stopping member 60 is held on the shutter plate guide 58*b* such that it can move parallel to the open/close direction of the shutter plate 58*a*, i.e., from a retract position in the shutter plate guide 58*b* into the opening 53. As to the scraper 20 and the movement of the stopping member 60, detailed description will be made later.

FIG. 4 is a side view of the toner container 31. As illustrated in FIG. 4, the toner container 31 is cylindrical in shape, and as it rotates on its cylinder axis, ejects the toner contained therein into a first recessed portion 41 (FIG. 5) through a toner exit 43 (FIG. 5, described later). As shown in FIG. 4, the toner container 31 includes a first container portion 33, a second container portion 34, and a third container portion 35, all cylindrical in shape. The first container portion 33, the second container portion 34, and the third container portion 35 are produced in one piece by blow molding, using a synthetic resin such as polyethylene, for example. The third container portion 35 is formed between the first container portion 33 and the second container portion 34.

The first container portion 33 of the toner container 31 is joined to a main-body joint 80 (see, e.g. FIG. 1) provided in the printer 100. Accordingly, the first container portion 33 on its bottom portion 33*a* has two convex container-side connection portions 37*a* and 37*b* that project out of the bottom portion 33*a* to be joined to the main-body joint 80. The distance from the center of the bottom portion 33*a*, i.e. from the cylinder axis of the cylindrical toner container 31 to the container-side connection portion 37*a* is different from the distance from the center of the bottom portion 33*a* (i.e. the cylinder axis) to the container-side connection portion 37*b*. In other words, the container-side connection portions 37*a* and 37*b* are not on a single circle. With this, the toner supply device 30 is inserted in the joint receiving section 81 through the intermediary of the container-side connection portions 37*a* and 37*b*, and the toner container 31 receives a driving power from a drive source 85 so as to rotate around the cylinder axis.

As illustrated in FIG. 4, the bottom portion 33*a* further includes a toner supply opening 45 formed through a portion of the bottom portion 33*a*, and a lid 46 detachably provided on the toner supply opening 45. The toner supply opening 45 is provided to supply toner to the toner container 31. Further, the toner supply opening 45 is circular in shape and formed at a central portion of the bottom portion 33*a*, with its center coinciding with the cylinder axis. The lid 46 closes the toner supply opening 45 by completely covering it. Further, the lid 46 is fastened such that the rotation of the toner container 31 on the cylinder axis does not separate the lid 46 from the toner supply opening 45. In supplying toner to the toner container 31 through the toner supply opening 45, the lid 46 is separated from the toner supply opening 45.

As illustrated in FIG. 4, the inner surface along the circumference of the first container portion 33 ("inner circumferential surface" hereinafter) has a plurality of transport portions 36 for transporting the toner inside the toner container 31 in a direction along the cylinder axis. The transport portions 36 are provided to project out of the inner circumferential surface toward the cylinder axis. Further, the transport portions 36 are spaced apart from one another at predetermined intervals both in the circumferential direction and cylinder axis direction of the first container portion 33. In the cylinder axis direction, the transport portions 36 are formed parallel to one another.

In order to transport toner from the bottom portion 33*a* toward the third container portion 35, the transport portions 36 formed on the inner circumferential surface of the first toner portion 33 are tilted on a predetermined angle with respect to a direction perpendicular to the cylinder axis of the toner container 31. Specifically, each transport portion 36 is formed such that a portion thereof downstream with respect to the direction of rotation of the toner container 31 on the cylinder axis is closer than the upstream portion to the third container portion 35 having the toner exit 43 (FIG. 5).

Further, the second container portion 34, as shown in FIG. 4, is provided on the opposite side of the toner container 31 from the main-body joint 80 provided in the printer 100 (see FIG. 1). The second container portion 34, closing the toner container 31 with its bottom portion 34*a*, is formed such that its inner diameter is equal to the inner diameter of the first container portion 33.

The inner circumferential surface of the second container portion 34 has a plurality of transport portions 39 for transporting the toner inside the toner container 31 in a direction along the cylinder axis. The transport portions 39 are provided to project out of the inner circumferential surface toward the cylinder axis. Further, the transport portions 39 are spaced apart from one another at predetermined intervals both in the circumferential direction and cylinder axis direction of the second container portion 34. In the cylinder axis direction, the transport portions 39 are formed parallel to one another.

In order to transport toner from the bottom portion 34*a* toward the third container portion 35, the transport portions 39 formed on the inner circumferential surface of the second container portion 34 are tilted on a predetermined angle with respect to a direction perpendicular to the cylinder axis of the toner container 31. Specifically, each transport portion 39 is formed such that a portion thereof downstream with respect to the direction of rotation of the toner container 31 on the cylinder axis is closer than the upstream portion to the third container portion 35 having the toner exit 43 (FIG. 5).

As described above, the third container portion 35 is provided between the first container portion 33 and the second container portion 34 in the toner container 31. Accordingly, the transport portions 39 of the second toner container portion 34 and the transport portions 36 of the first container portion 33 are tilted in opposite directions. With the transport portions 36 and the transport portions 39, the rotation of the toner container 31 causes the toner respectively stored in the first container portion 33 and the second container portion 34 to be guided into the third container portion 35 from the respective bottom portions 33*a* and 34*b* of the toner container 31.

As shown in FIG. 4, the third container portion 35 has a greater inner diameter than the first container portion 33 and the second container portion 34. This ensures that the toner transported from the first container portion 33 and the second container portion 34 always moves into the third container portion 35, thereby always ensuring constant toner supply in the third container portion 35. With a predetermined amount of toner stored in the third container portion 35 after the rotation of the toner container 31, toner can be stably supplied at the start of rotation of the toner container 31. Further, because the amount of toner supply in the third container portion 35 can be maintained constant even when the amount of toner remaining in the toner container 31 has become small, toner can be stably supplied over an extended time period.

FIG. 5 is a perspective view showing the third container portion 35 in detail. As illustrated in FIG. 5, the third container portion 35 is formed around the toner container 31 along the direction of rotation of the toner container 31. The third container portion 35 has a recessed portion forming portion (recessed portion forming region) 35*a* and guide flap forming portions 35*b* and 35*c*, which are provided along the cylinder axis direction of the toner container 31. The recessed portion forming portion 35*a* is disposed between the guide flap forming portions 35*b* and 35*c*.

The recessed portion forming portion 35*a* has a first recessed portion (recessed portion) 41 and a second recessed portion 42, which are portions on the outer surface along the circumference of the third container portion 35 ("outer circumferential surface" hereinafter) depressed toward the cylinder axis. The first recessed portion 41 and the second recessed portion 42 are formed in the recessed portion forming portion 35*a* substantially symmetrical to each other about the cylinder axis. Further, the first recessed portion 41 and the second recessed portion 42 are spaced apart from each other by a predetermined distance in a rotational direction R of the toner container 31 about the cylinder axis. Note that, since the first recessed portion 41 and the second recessed portion 42 are formed on the third container portion 35, the upper surface (top surface) of the toner in the third container portion 35 is higher than the first container portion 33 and the second container portion 34.

The first recessed portion 41 provides a space for keeping ejected toner from the toner container 31. The first recessed portion 41 is also a space for transporting toner into a toner supply port (developer supply port) 50 (FIG. 6) to be described later. The first recessed portion 41 and the second recessed portion 42 are depressions on the outer circumferential surface of the third container portion 35 and therefore reduce the area of contact between the third container portion 35 and the support member 32 (FIG. 12) when the toner container 31 rotates. This reduces the friction between the supporting member 32 and the toner container 31 when the toner container 31 rotates, thus smoothly rotating the toner container 31.

As shown in FIG. 5, the first recessed portion 41 has an end wall 41*a*, a bottom wall 41*b*, and a first side wall 41*c*, and a second side wall 41*d*. The end wall 41*a* is at an end of the first recessed portion 41 downstream in the rotational direction R of the toner container 31, and is perpendicular to the outer circumferential surface of the recessed portion forming portion 35*a*. The toner exit (exit) 43 formed through the toner container 31 is provided in the end wall 41*a*, allowing the toner contained in the toner container 31 to be ejected into the first recessed portion 41.

The bottom wall 41*b* is provided along the rotational direction R, with its downstream end with respect to the rotational direction R continuous to the end wall 41*a*, and with its upstream end gradually continuing to the outer circumferential surface of the third container portion 35. That is, the bottom wall 41*b* is provided substantially parallel to the outer circumferential surface of the recessed portion forming portion 35*a*, and closer to the cylinder axis than the outer circumferential surface.

The first side wall 41*c* and the second side wall 41*d* of the first recessed portion 41 are provided at the respective ends of the toner container 31 with respect to the cylinder axis direction, parallel to each other and perpendicular to the bottom wall 41*b* and the outer circumferential surface of the recessed portion forming portion 35*a*. The first side wall 41*c* and the second side wall 41*d* are continuous to the end wall 41*a* on the downstream side in the rotational direction R of the toner container 31. On the upstream side, the first side wall 41*c* and the second side wall 41*d* are continuous to the outer circumferential surface of the third container portion 35.

On the other hand, the second recessed portion 42 has a bottom wall 42*b*, and a first side wall 42*c* and a second side wall 42*d*, as shown in FIG. 5. The bottom wall 42*b* is formed along the rotational direction R of the toner container 31, with its ends on the upstream and downstream sides of the rotational direction R gradually continuing to the outer circumferential surface of the third container portion 35. That is, the bottom wall 42*b* is substantially parallel to the outer circumferential surface of the third container portion 35, and closer to the cylinder axis than the outer circumferential surface.

The first side wall 42*c* and the second side wall 42*d* of the second recessed portion 42 are provided at the respective ends of the toner container 31 with respect to the cylinder axis direction, parallel to each other and perpendicular to the bottom wall 42*b* and the outer circumferential surface. Further, the first side wall 42*c* and the second side wall 42*d* are continuous to the outer circumferential surface of the third container portion 35 on the upstream and downstream sides in the rotational direction R.

The guide flap forming portions 35*b* and 35*c* include a plurality of ejection guide flaps 44*b* and 44*c*, respectively, which project out of the outer circumferential surface away from the cylinder axis, i.e. project outwardly. The ejection guide flaps 44*b* and 44*c* are provided to guide toner into the first recessed portion 41 and/or the second recessed portion 42 when the toner ejected through the toner exit 43 of the first recessed portion 41 spreads onto the guide flap forming portions 35*b* and 35*c*. Details of this will be described later.

The guide flap forming portion 35*b* defines an end of the third container portion 35 on the side of the first container portion 33. The ejection guide flaps 44*b* are formed along the outer circumferential surface of the guide flap forming portion 35*b* at predetermined regular intervals, parallel to one another. Further, the ejection guide flaps 44*a* are tilted at a predetermined angle with respect to the cylinder axis of the toner container 31, instead of being provided parallel thereto, so that the toner on the guide flap forming portion 35*b* can be desirably guided into the recessed portion forming portion 35*a* by the rotation of the toner container 31 on its cylinder axis.

The guide flap forming portion 35*c* defines an end of the third container portion 35 on the side of the second container portion 34. The ejection guide flaps 44*c* are formed along the outer circumferential surface of the guide flap forming portion 35*c* at predetermined regular intervals, parallel to one another. Further, the ejection guide flaps 44*c* are tilted at a predetermined angle with respect to the cylinder axis of the toner container 31, instead of being provided parallel thereto, so that the toner on the guide flap forming portion 35*c* can be desirably guided into the recessed portion forming portion 35*a* by the rotation of the toner container on its cylinder axis. Note that, the ejection guide flaps 44*b* and 44*c* are tilted in opposite directions.

The third container portion 35 also has a seal 62 for sealing the toner exit 43 of the first recessed portion 41, as shown in FIG. 5. One end of the seal 62 is stuck on the toner exit 43 of the first recessed portion 41 to seal the opening, while the other end is fixed on the scraper 20 (see FIG. 6). The seal 62 may be made of a material such as polyethylene terephthalate (PET). However, the material of the seal 62 is not just limited to PET and any material can be used as long as it can provide adhesion to seal the toner exit 43. Examples of such materials include polyethylene, polypropylene, and nonwoven fabric.

Figure 6:
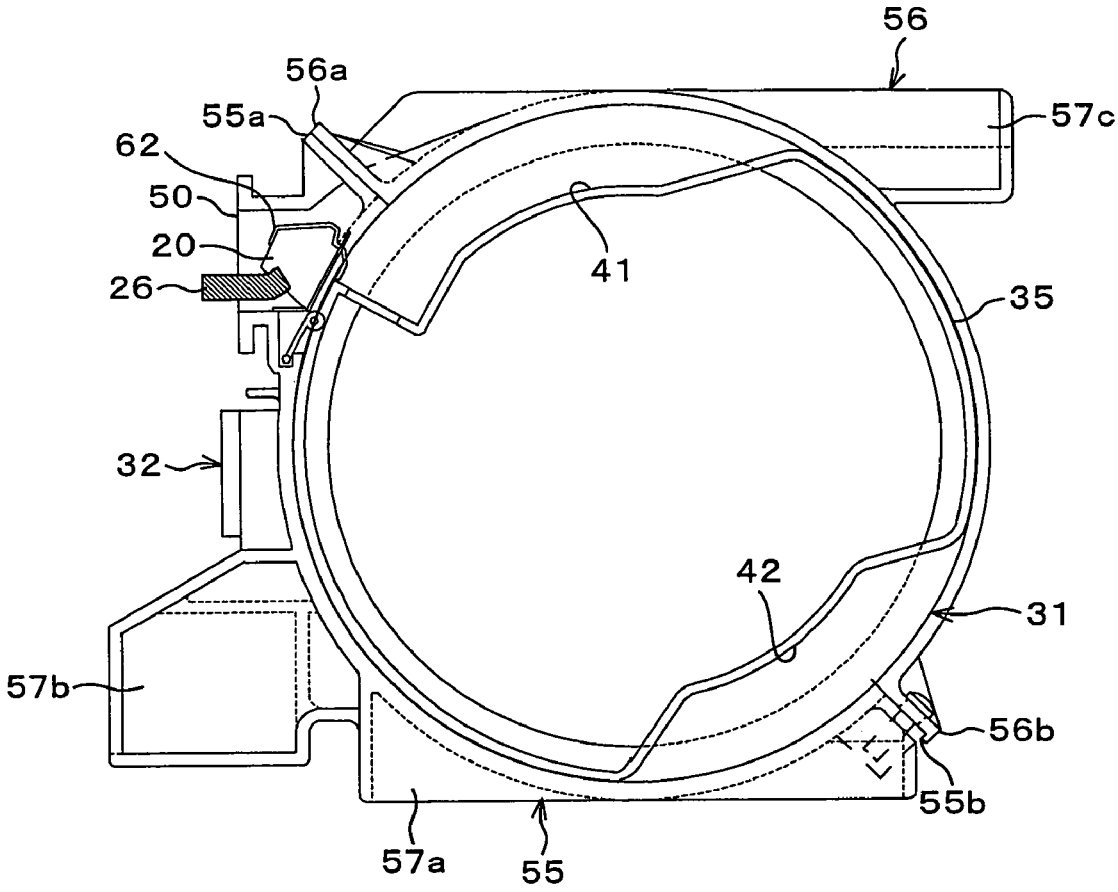
FIG. 6 is a longitudinal sectional view showing the third container portion and a support member of the toner supply device shown in FIG. 4.

As illustrated in FIG. 12, the support member 32 supports the third container portion 35 of the toner container 31 so as to allow for rotation on the cylinder axis L, as a rotation axis. Preferably, the support member 32 supports the toner container 31 by surrounding at least the entire area of the recessed portion forming portion 35*a* of the third container portion 35. FIG. 6 is a cross section illustrating the third container portion 35 and the support member 32. As shown in FIG. 6, the support member 32 includes a first support portion 55 and a second support portion 56. The first support portion 55 and the second support portion 56 together form a cylindrical space concentric to the cylinder axis of the toner container 31. With the third container portion 35 placed in the space, the first support portion 55 and the second support portion 56 surround the entire outer circumferential surface of the third container portion 35 and thereby support the toner container 31. Note that, the support member 32 supports the toner container 31 by surrounding the outer circumferential surface of the third container portion 35, including at least the recessed portion forming portion 35*a*.

The first support portion 55 and the second support portion 56 have round surfaces with curvatures according to the cylindrical shape of the third container portion 35. In the present embodiment, the first support portion 55 and the second support portion 56 with their round surfaces surround the outer circumferential surface of the third container portion 35, each covering half of the third container portion 35. In this way, the first support portion 55 and the second support portion 56 create the cylindrical space for supporting the toner container 31.

In order to provide such a cylindrical space, the first support portion 55 has joint portions 55*a* and 55*b* respectively at the both ends of its round surface with respect to the circumferential direction, as illustrated in FIG. 6. The joint portions 55*a* and 55*b* are perpendicular to the round surface and extend in a lengthwise direction of the cylinder. The second support portion 56 has joint portions 56*a* and 56*b* respectively at the both ends of its round surface with respect to the circumferential direction. The joint portions 56*a* and 56*b* are perpendicular to the round surface and extend in a lengthwise direction of the cylinder. The joint portions 55*a* and 55*b* of the first support portion 55 are in contact with the joint portions 56*a* and 56*b* of the second support portion 56, respectively, and are fixed thereto with a fixing member such as a screw. In this way, the inner round surface of the first support portion 55 meets the inner round surface of the second support portion 56, creating the cylindrical space.

Figure 7:
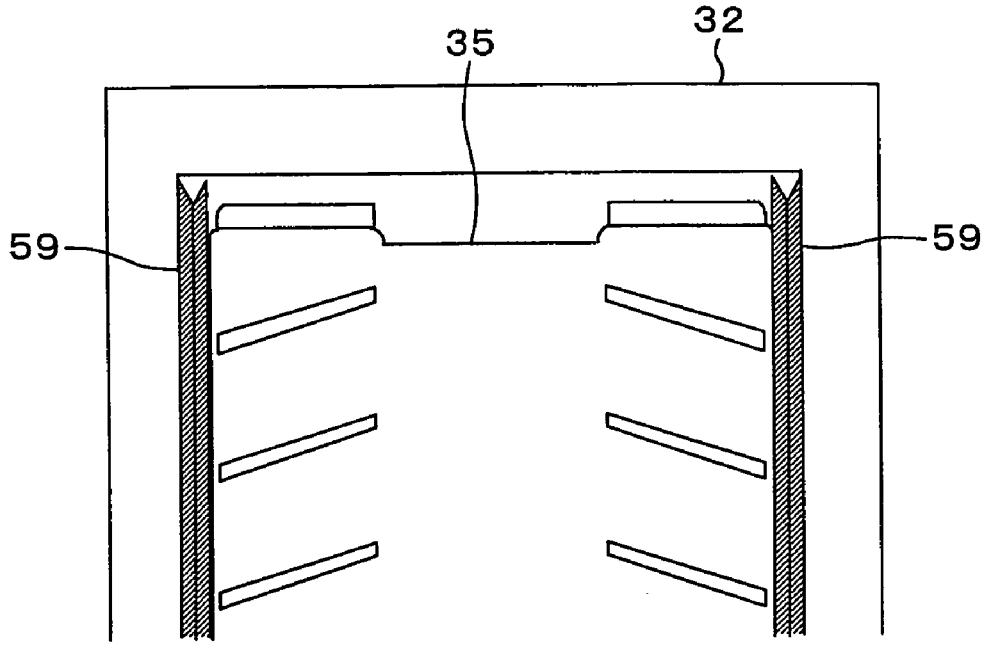
FIG. 7 is a cross sectional view showing a state where a V-seal is provided between the third container portion and the support member of the toner supply device shown in FIG. 4.

In order to support the toner container 31 with the support member 32, a V-seal 59 having a V-shape cross section is provided between the toner container 31 and the first and second support portions 55 and 56 of the support member 32, as illustrated in FIG. 7. The V-seal 59 may be made of an elastic material such as silicon rubber, for example. In the present embodiment, as shown in FIG. 7, owning to the fact that the support member 32 has a greater width (lengthwise width along the cylinder axis) than the third container portion 35, the V-seal 59 is wound along the circumference of the boundary portion between the first container portion 33 and the third container portion 35 and between the second container portion 34 and the third container portion 35, so as to close the gap between the toner container 31 and the support member 32.

By closing the gap between the toner container 31 and the support member 32 with the V-seal 59, the toner container 31 and the support member 32 can provide improved air-tightness. This prevents toner from spreading onto the first container portion 33 or the second container portion 34 even when toner leaks out of the space between the toner container 31 and the support member 32 during toner transport from the toner container 31 through the toner supply port 50 (FIG. 6, described later) of the support member 32. As a result, scattering of toner inside the printer 100 can be prevented.

Further, as illustrated in FIG. 6, the first support portion 55 and the second support portion 56 of the support member 32 include mount guide portions 57*b* and 57*c*, formed respectively on the round surfaces of the first support portion 55 and the second support portion 56. The mount guide portions 57*b* and 57*c* are provided to mount the toner supply device 30 in the printer 100. The first support portion 55 further includes a rib 57*a*. The rib 57*a* serves as a mount guide portion when the toner supply device 30 is to be mounted in the printer 100. When the toner supply device 30 is to be placed on an external surface of the printer 100, the rib 75*a* serves as a base, preventing the toner container 31 from rolling.

The first support portion 55 also has the toner supply port (developer supply port) 50, through which toner discharged through the exit 43 is transported to a toner opening provided on the toner hopper 8 side (FIG. 3, described later).

Figure 8:
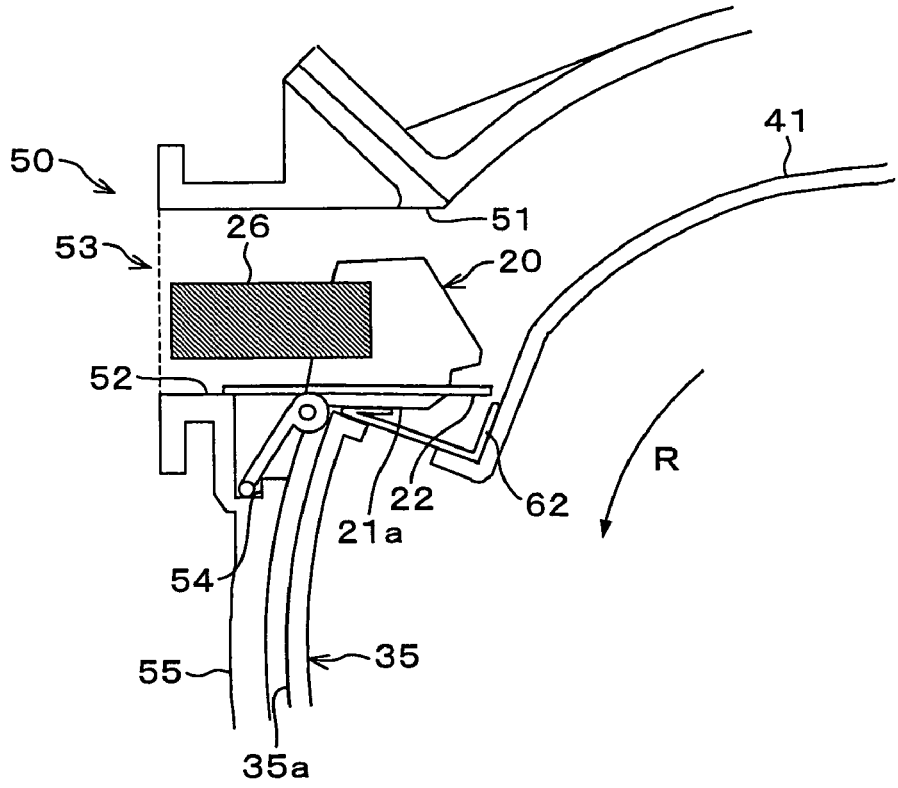
FIG. 8(*a*) is a cross sectional view showing a state where a toner ejecting sheet is positioned in a first recessed portion of the toner container shown in FIG. 6.
Figure 8:
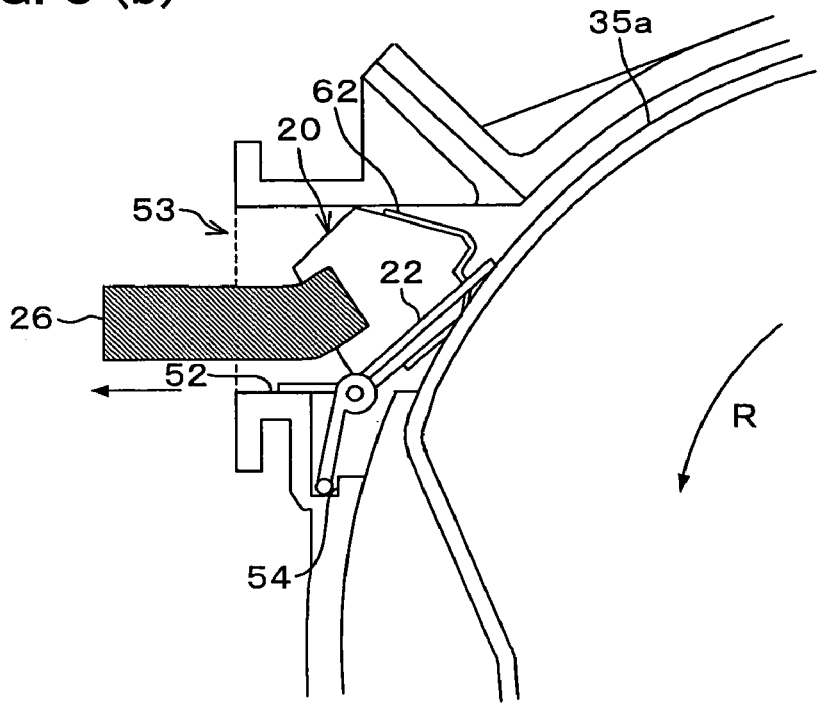
Figure 9:
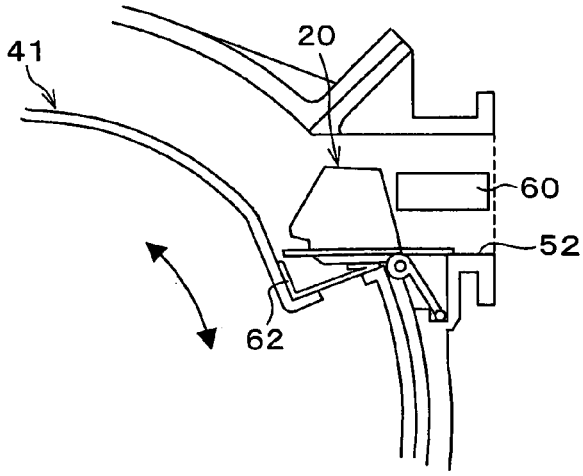
FIG. 9(*a*) is a cross sectional view showing the structure of the toner supply port and its peripheral area where the rotation of the toner container of the toner supply device shown in FIG. 1(*a*) is restricted.
Figure 9:
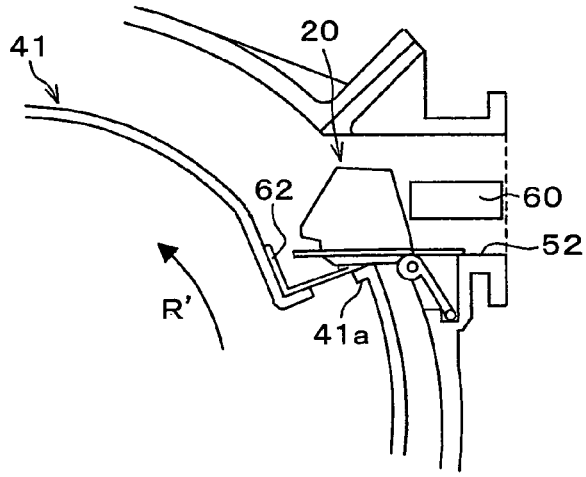
Figure 9:
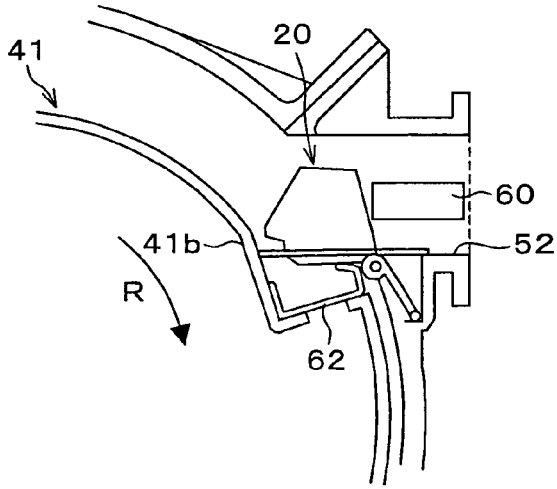

FIGS. 8(*a*) and 8(*b*) and FIGS. 9(*a*) through 9(*c*) are cross sectional views illustrating an area in the vicinity of the toner supply port 50. FIGS. 8(*a*) and 8(*b*) are cross sections in the vicinity of the toner supply port 50 as viewed from the first container portion 33 side, showing a aggregation preventing member 26 along with the other members. FIGS. 9(*a*) through 9(*c*) are cross sections in the vicinity of the toner supply port 50 as viewed from the second container portion 34 side, showing the stopping member 60 along with the other members.

As shown in FIG. 8(*a*), the toner supply port 50 has an opening 51, a toner transport path 52, and the opening 53. The opening 51 is formed through the round surface of the first support portion 55, and the opening 53 faces the toner hopper 8. The toner supplied from the toner container 31 is transported out of the toner supply device 30, i.e., to the toner hopper 8, through the opening 51, the toner transport path 52, and the opening 53. As shown in FIG. 3, the toner supply port 50 is provided such that it is above the cylinder axis L of the toner container 31 when the toner supply device 30 is installed in the printer 100.

The toner supply port 50 also has the scraper (scraping member) 20 for scraping the toner supplied from the toner container 31. The scraper 20 in the toner supply port 50 faces the toner container 31, and slides along the outer circumferential surface of the recessed portion forming portion 35*a* of the third container portion 35 (FIG. 5).

FIGS. 9(*a*) through 9(*c*) are cross sectional views in the vicinity of the toner supply port 50, showing a state in which the stopping member 60 projects into the opening 53 (i.e., the shutter plate 58*a* is closed). As shown in FIG. 9(*a*), the stopping member 60 is positioned such that it pushes the scraper 20 and thereby maintains the scraper 20 in the position projecting toward the first recessed portion 41 of the toner container 31. That is, the stopping member 60 moves into the opening 53 of the toner supply port 50, and holds the scraper 20 by pushing it toward the first recessed portion 41, thereby regulating the sliding of the scraper 20 (see FIGS. 9(*b*) and 9(*c*)). As to the movement of the stopping member 60, more detail will be described later.

Figure 10:
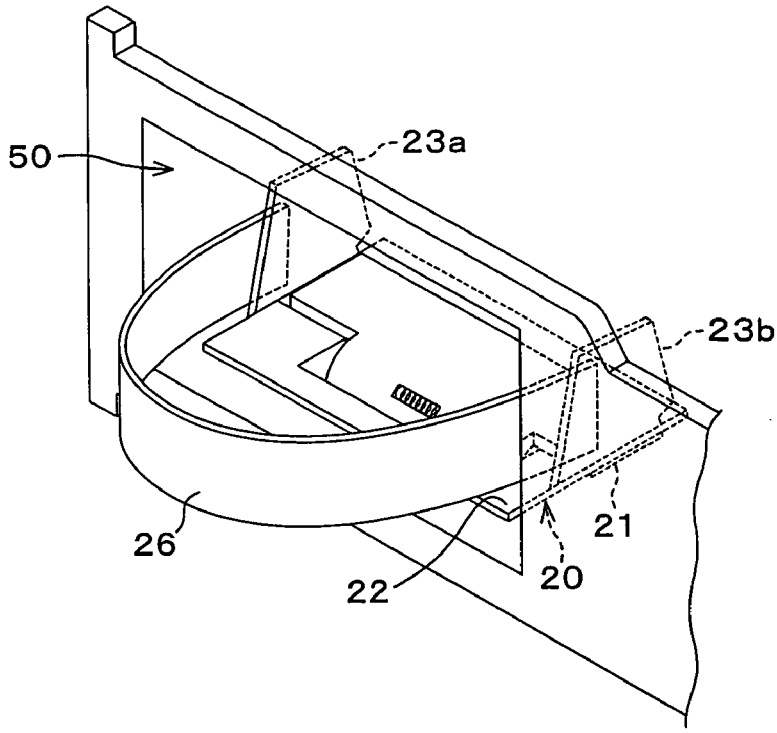
FIG. 10(*a*) is a perspective view showing the toner supply port as viewed from a toner hopper side in the toner supply device shown in FIG. 1(*a*).
Figure 10:
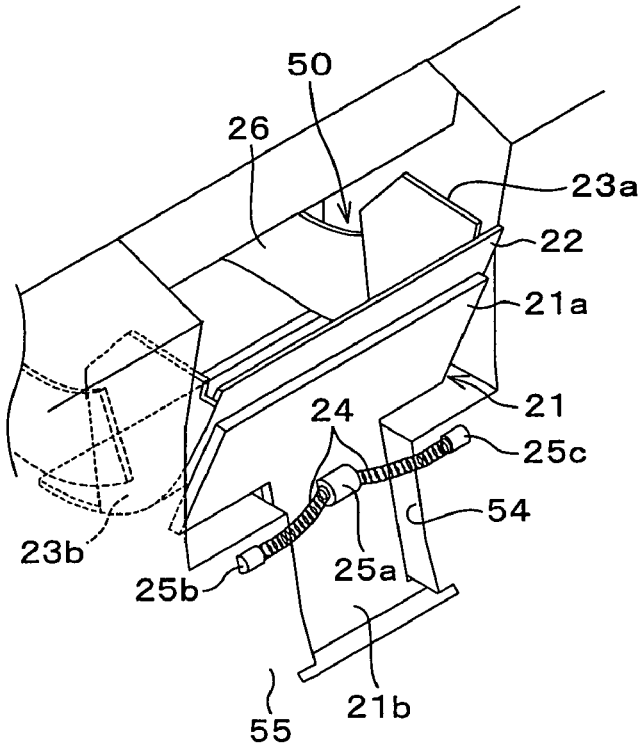

FIG. 10(*a*) is a perspective view showing the toner supply port 50 as viewed from the toner hopper 8 side. FIG. 10(*b*) is a perspective view showing the toner supply port 50 as viewed from the toner container 31 side. As illustrated in FIG. 10(*a*) and FIG. 10(*b*), the scraper 20 includes a base portion 21, a toner ejecting sheet 22, and walls 23*a* and 23*b*.

As shown in FIG. 10(*b*), the base portion 21 is a rigid body made of polyacetal resin and the like, and includes a sheet hold portion 21*a* and a fulcrum portion 21*b*. The sheet hold portion 21*a* holds a sliding end of the toner ejecting sheet 22 sliding on the recessed portion forming portion 35*a* (FIG. 5). The fulcrum portion 21*b* acts as a fulcrum for the scraper 20 when the scraper 20 slides on the recessed portion forming portion 35*a*. Further, the sheet hold portion 21*a* is provided to support the toner ejecting sheet 22, so that the toner ejecting sheet 22 will not deform (for example, will not be bent) even when an end of the toner ejecting sheet 22 is brought into contact with the recessed portion forming portion 35*a* by the movement of the scraper 20.

The fulcrum portion 21*b* extends from the sheet hold portion 21*a* with a predetermined angle relationship with the sheet hold portion 21*a*. As shown in FIG. 8(*a*), an end of the fulcrum portion 21*b* opposite the sheet hold portion 21*a* is inserted in a scraper mount portion 54, which is a recessed portion provided downstream with respect to the rotational direction of the toner container 31. The movement at this end of the fulcrum portion 21*b* is restricted in the scraper mount portion 54.

As shown in FIG. 10(*b*), in the base portion 21, the fulcrum portion 21*b* on the side facing the toner container 31 has a retaining member 25*a* retaining an elastic member 24 such as a spring. The both ends of the elastic member 24 are retained by retaining members 25*b* and 25*c*, respectively, with respect to the first support portion 55. With the elastic member 24 provided for the fulcrum portion 21*b*, the fulcrum portion 21*b* side of the base portion 21 of the scraper 20 is pulled toward the third container portion 35 of the toner container 31 on an angle. Thus, when the front end of the toner ejecting sheet 22 is not in contact with the recessed portion forming portion 35*a* (FIG. 5), the sheet hold portion 21*a* of the base portion 21 is held toward the third container portion 35, as shown in FIG. 8(*a*).

In this state, when the toner container 31 rotates in the rotational direction R, the front end of the toner ejecting sheet 22 is brought into contact with the outer circumferential surface of the recessed portion forming portion 35*a* and pressed against it. Accordingly, the scraper 20 rotates on the fulcrum portion 21*b* mounted on the scraper mount portion 54, so that the front end of the toner ejecting sheet 22 slides along the outer circumferential surface of the recessed portion forming portion 35*a*.

The toner ejecting sheet 22 is elastic, and made of a highly flexible material such as polyethylene terephthalate (PET). As shown in FIG. 10(*b*), the toner ejecting sheet 22 is fixed on the sheet hold portion 21*a* of the base portion 21 using, for example, a double-sided adhesion tape. Further, as shown in FIG. 8(*a*), the toner ejecting sheet 22 is positioned such that its end extending toward the fulcrum portion 21*b* of the base portion 21 is on the toner transport path 52, covering the scraper mount portion 54 and thereby preventing toner from entering the scraper mount portion 54 provided on the toner supply port 50.

By being elastic and flexible, the toner ejecting sheet 22 can slide along the recessed portion forming portion 35*a* with its front end pressed against the recessed portion forming portion 35*a*. By being able to slide, the toner ejecting sheet 22 can bend between the sheet hold portion 21*a* and the fulcrum portion 21*b* and can slide on the toner transport path 52 above the scraper mount portion 54, as shown in FIG. 8(*b*), when the sheet hold portion 21*a* of the base portion 21 is lifted up.

The walls 23*a* and 23*b* are provided on the sides of the toner ejecting sheet 22 with respect to the transport direction of toner, and are provided perpendicular to the toner ejecting sheet 22, as shown in FIG. 10(*a*), so that the toner ejected through the opening 51 (FIG. 8(*a*)) can be desirably transported to the toner transport path 52. The toner ejecting sheet 22 and the walls 23*a* and 23*b* may be formed in one piece. In this case, for example, end portions of an elastic resin sheet are bent to provide the toner ejecting sheet 22 and the walls 23*a* and 23*b*.

In order to ensure toner flow in the toner transport path 52, the aggregation preventing member 26 is provided for the scraper 20, as shown in FIG. 8(*a*). The aggregation preventing member 26 has an arc shape with its both ends respectively fixed to the walls 23*a* and 23*b* of the scraper 20, as shown in FIG. 10(*a*). Further, the aggregation preventing member 26 is provided on the toner transport path 52.

Though detailed description will be made later, the stopping member 60 escapes from the toner transport path 52 when the shutter 58 is open, as shown in FIG. 17(*d*). With the shutter 58 closed, as shown in FIG. 17(*b*) and FIGS. 9(*a*)-9(*c*), the stopping member 60 projects into the toner transport path 52 provided behind the scraper 20, positioning itself behind the scraper 20, i.e., on the toner supply port 50 side. When moving the shutter 58 for opening or closing, the scraper 20 projects out of the toner supply port 50 into the first recessed portion 41 side, as shown in FIGS. 9(*a*)-9(*c*). The aggregation preventing member 26 is provided on the scraper 20 in such a manner that it does not hinder the pushing of the scraper 20 or the movement of the stopping member 60 projecting into the opening 53 side.

The aggregation preventing member 26 is prepared as a sheet by molding, for example, polyethylene terephthalate (PET), acrylonitrile butadiene styrene (ABS) resin, polyolefin, and the like. It is preferable that the aggregation preventing member 26 have a thickness in a range of 50 μm to 200 μm, and be elastic. By being prepared from an elastic material molded into a thin sheet, the aggregation preventing member 26 can freely undergo elastic deformation, thus improving flexibility of the aggregation preventing member in terms of its shape.

Thus, by the pressure of the stopping member 60, the aggregation preventing member 26 deforms according to the shape of the scraper 20, and therefore does not interfere with the stopping member 60 when the stopping member 60 projects into the opening 53 to push the scraper 20.

As shown in FIG. 8(*a*) and FIG. 8(*b*), the aggregation preventing member 26 moves above the toner transport path 52 in the transport direction of toner by interlocking with the movement of the scraper 20. This enables the toner on the toner transport path 52 to be pushed onto the toner hopper 8 side through the opening 53 of the toner supply port 50, thereby preventing the toner from being stuck on the toner transport path 52.

Figure 11:
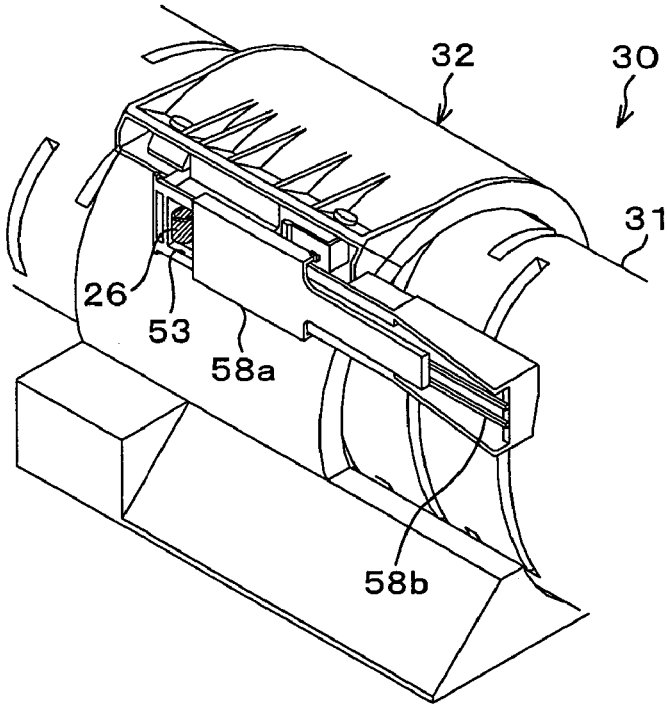
FIG. 11(*a*) is a perspective view showing the movement of a shutter in the process of detaching the toner supply device shown in FIG. 1(*a*) from the printer.
Figure 11:
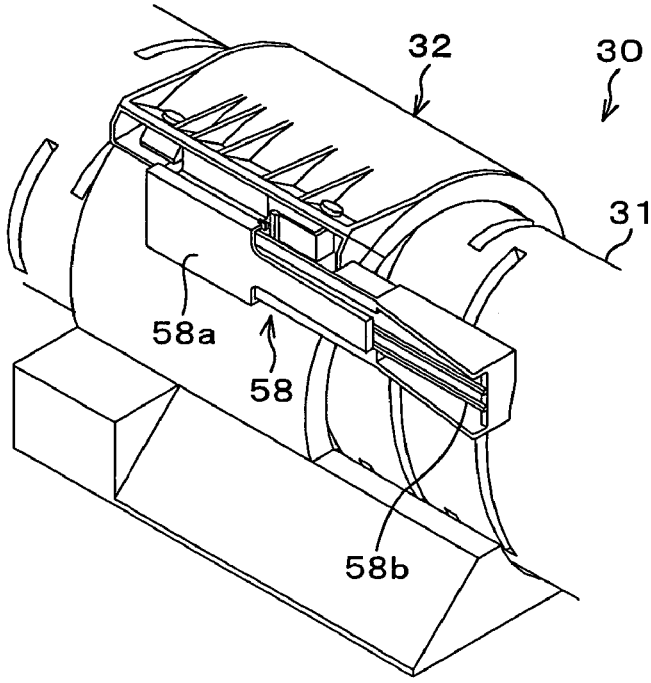

As illustrated in FIGS. 12(*a*) and 12(*b*), the toner supply port 50 has the shutter 58 for opening or closing the opening 53 (i.e. the toner supply port 50) provided on the toner hopper 8 side of the toner supply port 50. As described earlier, the shutter 58 includes the shutter plate 58*a* for covering the toner supply port 50, and the shutter plate guide 58*b* for allowing the shutter plate 58*a* to slide in a direction parallel to the cylinder axis of the toner container 31. With the toner supply device 30 installed in the printer 100 (FIG. 2), the shutter 58 opens the opening 53 of the toner supply 50, as shown in FIGS. 12(*a*) and 12(*b*). When detaching the toner supply device 30 from the printer 100, the shutter plate 58*a* slides along the shutter plate guide 58*b* as the toner supply device 30 is detached, as shown in FIG. 11(*a*). With the aggregation preventing member 26 housed in the toner supply port 50, the shutter plate 58*a* covers the opening 53 of the toner supply 50, as shown in FIG. 11(*b*).

The toner supply device 30 as structured above is detachably provided in the printer 100. When installing the toner supply device 30 in the printer 100, the toner supply device 30 is inserted in the vicinity of the toner hopper 8 in the printer 100, as shown in FIG. 2. This is carried out by inserting the first container portion 33 end (FIG. 4) of the toner container 31 into the printer 100, and by guiding the toner supply device 30 along the rib 57*a* and the mount guide portions 57*b* and 57*c* (FIG. 6).

When the toner supply device 30 is not installed in the printer 100, the shutter 58 covers the opening 53 of the toner supply port 50 and closes it, as shown in FIG. 11(*b*). As such, a shutter displacing member (not shown) is provided in a mount area of the printer 100 where the toner supply device 30 is mounted. In this way, when installing the toner supply device 30 in the printer 100, the shutter plate 58*a* of the shutter 58 provided on the support member 32 of the toner supply device 30 slides and thereby opens the toner supply port 50, as shown in FIGS. 12(*a*) and 12(*b*). By installing the toner supply device 30 in the printer 100 in this manner, the shutter 58 slides and the toner supply port 50 opens, thereby connecting the opening 53 of the toner supply port 50 to the toner supply port (not shown) of the toner hopper 8.

Figure 18:
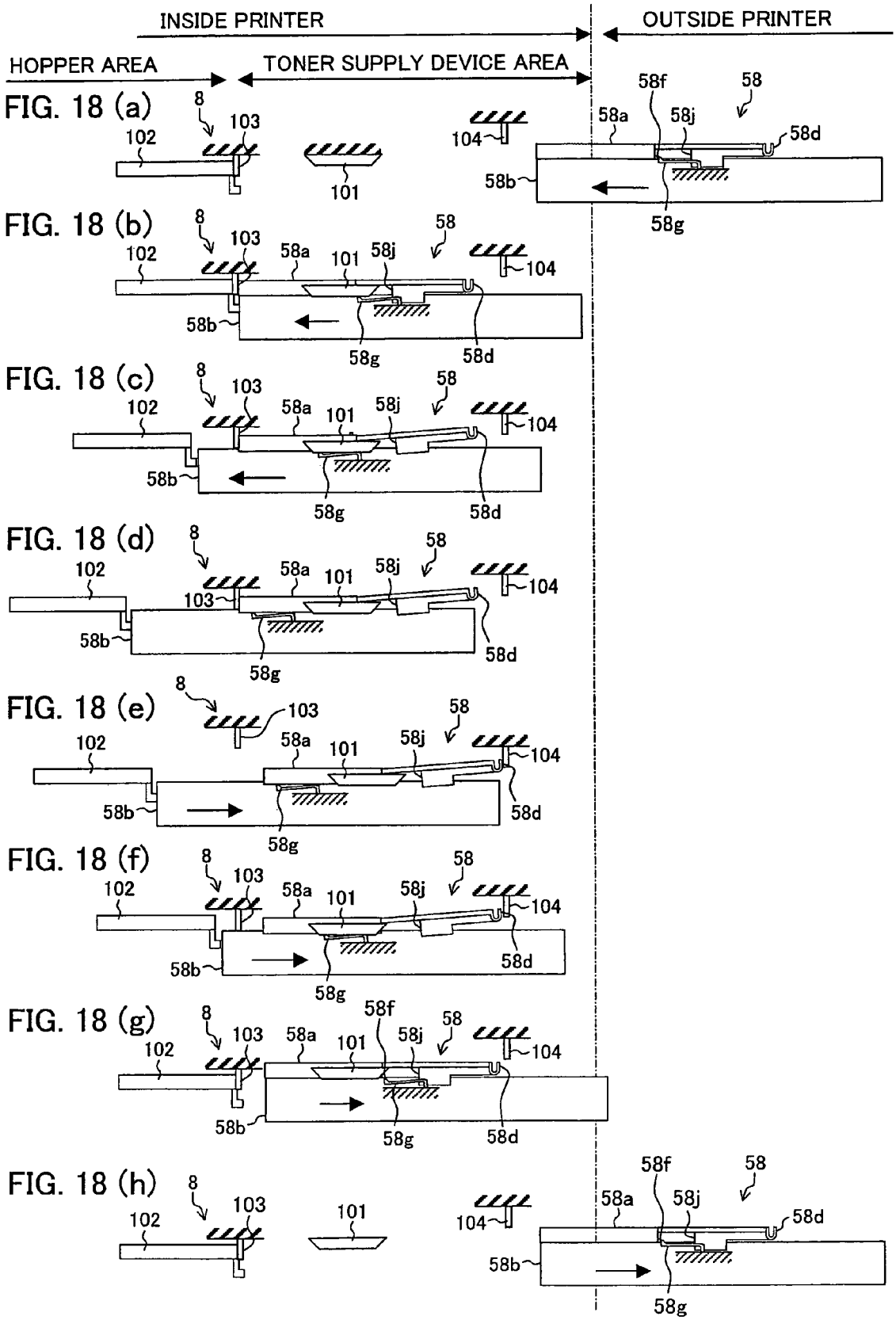
FIG. 18(*a*) illustrates opening and closing of the shutter when the toner supply device shown in FIG. 1(*a*) is installed in the printer, and is a cross sectional view showing a state at the start of installation.

Next, with reference to FIGS. 18(*a*)-18(*h*), the following will describe opening and closing operations of the shutter plate 58*a* in detaching/attaching the toner supply device 30 from/to the printer 100. FIGS. 18(*a*)-18(*h*) is a diagram illustrating opening and closing operations of the shutter 58 in installing the toner supply device 30 in the printer 100. For convenience of explanation, FIGS. 18(*a*)-18(*h*) illustrates only the shutter 58 in the toner supply device 30.

As shown in FIG. 18(*a*), in the toner supply device 30 before being installed in the printer 100, the shutter plate 58*a* is closed. At the present case, the locking pawl 58*f* provided on the shutter plate 58*a* is stopped by the stopper 58*g* provided on the shutter plate guide 58*b*. That is, the stopper 58*g* serves to prevent the shutter plate 58*a* from being opened accidentally.

When being installed in the printer 100, the toner supply device 30 is moved so as to slide in parallel with the rotation axis of the toner container 31 from the outside of the printer 100 to a toner supply device area. At the present case, as shown in FIG. 18(*b*), a rib 101 fixed to the toner hopper 8 pushes down the stopper 58*g* toward the toner container 31. This releases stopping of the locking pawl 58*f* by the stopper 58*g*. Therefore, when stopping of the shutter plate 58*a* by the stopper 58*g* is released, the shutter plate 58*a* becomes movable.

Then, as shown in FIG. 18(*c*), when the toner supply device 30 reaches a hopper area inside the printer 100, an end of a hopper shutter 102, provided on the toner hopper 8 side, for closing the toner supply port of the toner hopper 8 comes into contact with the shutter 58 as well as the end of the shutter plate 58*a* comes into contact with an opening pawl 103 firmly disposed to the toner hopper 8 side. Further, when the toner supply device 30 is moved in the hopper area, the hopper shutter 102 moves in the hopper area along with the toner supply device 30. This opens the toner supply port of the toner hopper 8. Further, the opening pawl 103 causes the shutter plate 58*a* to slide in an opposite direction to the movement direction of the shutter 58, i.e. in an opening direction of the shutter plate 58*a*. This opens the shutter plate 58*a*. That is, the toner supply port 50 of the toner supply device 30 is opened.

Then, as shown in FIG. 18(*d*), when the hopper shutter 102 and the shutter plate 58*a* become completely open, the toner supply device 30 comes into contact with a stopper (not shown) in the printer 100 and stops. This completes installing operation of the shutter 58 to the printer 100. At the present case, the toner supply port 50 and the toner supply port of the toner hopper 8 face each other.

On the other hand, as shown in FIG. 18(*e*), when the toner supply device 30 having been installed in the printer 100 is detached, the hopper shutter 102 moves along with the toner supply device 30 by a force applied from a spring (not shown). That is, the hopper shutter 102 moves with movement of the toner supply device 30 to the outside of the printer 100. This closes the toner supply port of the toner hopper 8. When the toner supply port of the toner hopper 8 is closed, the hopper shutter 102 comes into contact with a stopper (not shown) on the hopper side and stops.

When the toner supply device 30 is moved in the direction of removal from the printer 100, i.e. in the direction of removing the toner supply device 30 from the printer 100, as shown in FIG. 18(*f*), the elastic end portion 58*d* provided to shutter plate 58*a* being pushed up toward the toner container 31 side by the shutter plate guide 58*b* comes into contact with a closing pawl 104 which is firmly provided to the toner hopper 8. When the toner supply device 30 is further moved, the shutter plate guide 58*b* moves in a direction of removal of the toner supply device 30, but the shutter plate 58*a* stopped by the closing pawl 104 does not move. Therefore, the shutter plate 58*a* moves relatively to the shutter plate guide 58*b*, whereby the toner supply port 50 (opening 53) is closed by the shutter plate 58*a*. Further, the elastic end portion 58*d* that can undergo elastic deformation gets snagged in the closing pawl 104 on the hopper 8 side, whereby the elastic end portion 58*d* does not go down to the shutter plate guide 58*b* side. This prevents the occurrence of the problem that the shutter plate 58*a* is not closed.

Then, as shown in 18(*g*), when the opening 53 is completely closed by the shutter plate 58*a*, the shutter 58 comes into contact with a stopper (not shown) of the shutter 58, thus prohibiting a further relative movement of the shutter plate 58*a*. Further, the stopper 58*g* having been pushed down to the toner container 31 side is released by the rib 101, so that the stopper 58*g* is pushed up to the opposite direction of the toner container 31 side. With this arrangement, the stopper 58*g* stops the locking pawl 58*f*, thus preventing the shutter plate 58*a* from being opened accidentally for user's operating error and other reasons.

Then, the elastic end portion 58*d* is fitted again to the notch 58*e* (see FIG. 12(*b*) of the shutter plate guide 58*b*. With application of a force to the elastic end portion 58*d* when relative movement of the shutter plate 58*a* and the shutter plate guide 58*b* is prohibited, the elastic end portion 58*d* undergoes elastic deformation. This frees from unmoving of the shutter plate 58*a* caused when the elastic end portion 58*d* gets snagged in the notch 58*e*, and frees from damage to the shutter plate 58*a* due to application of an excessive load to the shutter plate 58*a*. This allows the shutter plate 58*a* to be opened or closed without any trouble, so that the toner supply device 30 can be detached smoothly from the printer 100.

As shown in FIG. 18(*h*), the toner supply device 30 is completely detached from the printer 100 with the shutter plate 58*a* closed completely. At the present case, the U-shape end portion 58*d* fits the notch 58*e*, and the stopper 58*g* restricts accident opening of the shutter plate 58*a*.

In this manner, opening and closing operations of the shutter plate 58*a* are performed in detaching and attaching the toner supply device 30 from and to the printer 100.

Referring to FIGS. 17(*a*)-17(*e*), the operation of the stopping member 60 at the time of opening and closing the shutter plate 58*a* of the shutter 58 is described in a more specific manner. FIGS. 17(*a*)-17(*e*) are cross sections for illustrating the operation of opening and closing the shutter 58 in the toner supply device 30.

Next, as to the operation of the stopping member 60 in opening and closing operations of the shutter 58, detailed description will be made below with reference to FIGS. 17(*a*) through 17(*e*).

As mentioned above, the stopping member 60 is held on the shutter plate guide 58*b* of the shutter 58 such that it can move parallel to the opening and closing direction of the shutter plate 58*a*. Further, as shown in FIG. 17(*a*), the stopping member 60 is provided with an end wall (projection) 60*a* on its surface facing the shutter plate 58*a* and being opposite to the opening 53, i.e. at the end of the stopping member 60 in the opening direction of the shutter plate 58*a*. The end wall 60*a* is provided so as to project in the direction of the shutter plate 58*a*. Further, the shutter plate 58*a* on the back surface of the opening covering portion 58*h* is bonded with the felt 61 and has the projection 58*c* which is provided so as to engage with the end wall 60*a*. Meanwhile, the shutter plate 58*a* on the back surface of the slider portion 58*i* has a plate projection 58*j*, which stands substantially perpendicular to the plane of the back surface.

Further, when the toner supply device 30 is not in use and is not installed in the printer 100 (image forming apparatus), the shutter plate 58*a* covers the opening 53 of the toner supply port 50 and is closed.

FIG. 17(*b*) illustrates the shutter plate 58*a* (the opening 53) being closed. At this moment, the stopping member 60 projects into the opening 53 side, and the elastic end portion 58*d* is fitted to the notch 58*e* provided on the shutter plate guide 58*b*. With the elastic end portion 58*d* projected out, when the toner container 31 is removed from the developer supply device 30, the elastic end portion 58*d* comes into collision with other objects. This could cause detachment and breakage of the shutter plate 58*a*, resulting in breakdown of the shutter 58. However, according to the present embodiment, the elastic end portion 58*d* is fitted to the notch 58*e* and is retracted, thus preventing damage to the shutter 58.

Next, as shown in FIG. 17(*c*), when the shutter plate 58*a* is moved in the opening direction (in the direction of opening the opening 53; in the direction indicated by an arrow in FIG. 17(*c*)) the elastic end portion 58*d* is released from the notch 58*e*, and the stopping member 60 is moved to the shutter plate guide 58*b* side by friction with the felt 61 provided on the back surface of the shutter plate 58*a*.

At this moment, the projection 58*c* is engaged with the end wall 60*a*, so that the shutter 58 can force the stopping member 60 to retract from the opening 53. As a result, as shown in FIG. 17(*d*), when the shutter plate 58*a* is completely opened, the stopping member 60 is retracted from the opening 53 (i.e. the stopping member 60 becomes the open state).

When the shutter plate 58*a* is closed again, as shown in FIG. 17(*e*), as is the case when the shutter plate 58*a* being closed is opened, the engagement of the end wall 60*a* by the projection 58*c* is released and the stopping member 60 moves into the opening 53 by friction between the felt 61 and the stopping member 60.

FIGS. 9(*a*) through 9(*c*) are cross sections in the vicinity of the toner supply port 50 when the stopping member 60 projects into the opening 53.

As mentioned previously, when the shutter plate 58*a* being opened is closed, the stopping member 60 is moved to the opening 53 side by friction with the shutter plate 58*a* and then is stopped in such a manner so as to be projected into the opening 53. Therefore, the scraper 20 is pressed by the stopping member 60, thereby projecting into the first recessed portion 41. In other words, the stopping member 60 serves to prohibit escaping of the scraper 20 from the first recessed portion 41 when the shutter plate 58*a* is closed.

When the toner container 31 rotates downward with respect to the scraper 20 i.e. in the normal rotation direction, that is, when the toner container 31 rotates in the direction indicated by an arrow R, as shown in FIG. 9(*c*), the scraper 20 being prohibited its rotation by the stopping member 60 slides in contact along the bottom wall 41*b* of the first recessed portion 41. This produces the friction between the scraper 20 and the bottom wall 41*b*, thus restricting the rotation of the toner container 31. The bottom wall 41*b* is provided substantially parallel to the outer circumferential surface of the toner container 31, thus reducing impact caused by sliding of the scraper 20, as compared with the case where the scraper 20 slides in contact along the end wall 41*a*. Therefore, it is possible to effectively stop the rotation of the toner container 31 with a weak impact even when the toner container 31 being rotated is suddenly stopped. This can prevent breakdown of the toner container 31 caused by breakage of the components.

On the other hand, when the toner container 31 moves upward with respect to the scraper 20, i.e. in a direction opposite to the normal rotation direction, that is, when the toner container 31 moves in the direction indicated by an arrow R', as shown in FIG. 9(*b*), the scraper 20 being prohibited its rotation by the stopping member 60 comes into collision with the end wall 41*a* of the first recessed portion 41, thus restricting the rotation of the toner container 31.

As described above, when the shutter plate 58*a* is closed, the scraper 20 restricts the range where the toner container 31 is rotatable. This can prevent a spill of a toner from the toner exit 43 when the seal 62 sealing the toner exit 43 of the toner container 31 is unstuck by the rotation of the toner container 31 due to user's operating error. Further, regardless of which direction the toner container 31 rotates in, the scraper 20 being pressed by the stopping member 60 and projected into the first recessed portion 41 can restrict the rotation of the toner container 31. Therefore, even when the toner container 31 moves inside the toner supply device 30 due to vibrations and the like created during transport, the seal 62 is not unstuck, thus preventing a leakage of toner from the toner exit 43.

Further, a force applied to the stopping member 60 is not more than a predetermined value since the force is created by the friction between the felt 61 bonded on the back surface of the shutter plate 58*a* and the stopping member 60.

Therefore, in the case where the scraper 20 cannot be projected into the toner container 31 side, it is possible to prevent the stopping member 60 from being forced to move into the opening 53. This frees the scraper 20 from projecting to the toner container 31 side by the pressure of the stopping member 60. Therefore, it is possible to prevent breakage of the scraper 20, the stopping member 60, the shutter plate 58*a*, and others. Here, the case where the scraper 20 cannot be projected into the toner container 31 side is a case where the recessed portion forming portion 35*a* of the toner container 31 does not face the opening 53 of the toner supply port 50, and a case where movement of the scraper 20 to the toner container 31 side is hampered due to coagulation of a toner filled in the toner supply port 50 when the scraper 20 is not projected into the toner container 31 side.

Note that, the friction between the felt 61 and the stopping member 60 may be increased or stabilized by providing the stopping member 60 having a rack gear, an uneven surface created by knurling, or the like on a contact surface which comes into contact with the felt 61.

Meanwhile, in a case where the stopping member 60 is pulled out to the toner supply port 50 side when the opening 53 is opened by the shutter plate 58*a*, the scraper 20 cannot be retracted to the opening 51 side by the stopping member 60. At this moment, the toner container 31 cannot rotate, as shown in FIG. 9(*a*), since the scraper 20 is projected into the toner container 31 side (i.e. the scraper 20 is pushed into the first recessed portion 41). If the toner container 31 is now forced to rotate, there could occur a breakdown such as breakage of the scraper 20, the stopping member 60, the shutter plate 58*a*, and the main-body joint 80 which is a drive section (connecting member and gear) of the toner container 31. To solve such a problem, according to the present embodiment, the stopping member 60 can be forcibly moved along with opening of the shutter plate 58*a*, and when the shutter plate 58*a* is opened, the scraper 20 can be retracted to the toner supply port 50 side, so that the toner container 31 is rotatable. This can prevent the occurrence of the breakdown.

Further, in the toner supply device 30 having the toner container 31 not in use installed therein, the opening 53 is sealed with the seal 62. This reliably prevents a spill of a toner from the toner exit 43 of the toner container 31 due to user's operating error and other reasons. When the opening 53 is opened by the shutter plate 58*a*, and the toner container 31 starts rotating, sealing of the opening 53 with the seal 62 is unstuck by a first one rotation, so that toner supply from the opening 53 is possible. At this moment, as described above, other end of the seal 62 is fixed on the scraper 20, so that the seal 62 unstuck from the toner exit 43 is held by the scraper 20. Therefore, it is possible to prevent the toner container 31 from being hampered its rotation by the seal 62.

Therefore, the unstuck seal 62 causes no troubles in the subsequent operations of the toner container 31.

When the shutter plate 58*a* is burst open while sliding, the elastic end portion 58*d* comes into collision with the inner wall of the shutter plate guide 58*b* and stops. At this moment, a force of further sliding and opening the shutter plate 58*a* is created, and this force causes deformation or the like of the shutter plate 58*a*, whereby the shutter plate 58*a* digs into the shutter plate guide 58*b*. This could produce a breakdown such as failure of closing the shutter plate 58*a*. According to the present embodiment, the elastic end portion 58*d* has a U-shape cross section, thereby reducing impact caused when the shutter plate guide 58*b* comes into collision with the elastic end portion 58*d*. This can prevent breakdown of the shutter 58.

Further, by fitting the elastic end portion 58*d* in the notch 58*e* provided on the shutter plate guide 58*b*, it is also possible to add the function of stopping the shutter plate 58*a* at closed position.

Note that, in the present embodiment, the present embodiment has described that the elastic end portion 58*d* has a U-shape cross section. However, the present invention is not limited to this. The elastic end portion 58*d* may has an arc shape cross section, or a cross section with a shape such that the elastic end portion 58*d* can fit the notch 58*e* and impact caused by collision with the shutter plate guide 58*b* and the closing pawl 104 can be reduced.

Also, the shape of the stopping member 60, not limited to one that has been described in the present embodiment, may be any shape, provided that the stopping member 60 can move by interlocking with the shutter plate 58*a* being opened or closed, and moves into the toner supply port 50 when the shutter plate 58*a* is closed, and thereby pushes the scraper 20 into a recessed portion 41. The stopping member 60 is preferably made of material having elasticity and impact resistance, such as polyacetal resin (POM), or acrylonitrile-butadiene-styrene resin (ABS). In addition, the stopping member 60 is preferably made of material that is the same as material of which other members making up the shutter 58 is made, in view of designing.

Further, the printer 100 of the present invention includes the stopper 58*g*, so that with the shutter plate 58*a* closed the stopper 58*g* can stop the locking pawl 58*f* provided on the shutter plate 58*a*. This can prevent the shutter plate 58*a* from being opened accidentally. That is, it is possible to prevent the user and the toner container 31 from becoming dirty with a toner spilled out from the opening 51 when the user accidentally opens the shutter plate 58*a* after the seal 62 is unstuck.

Figure 14:
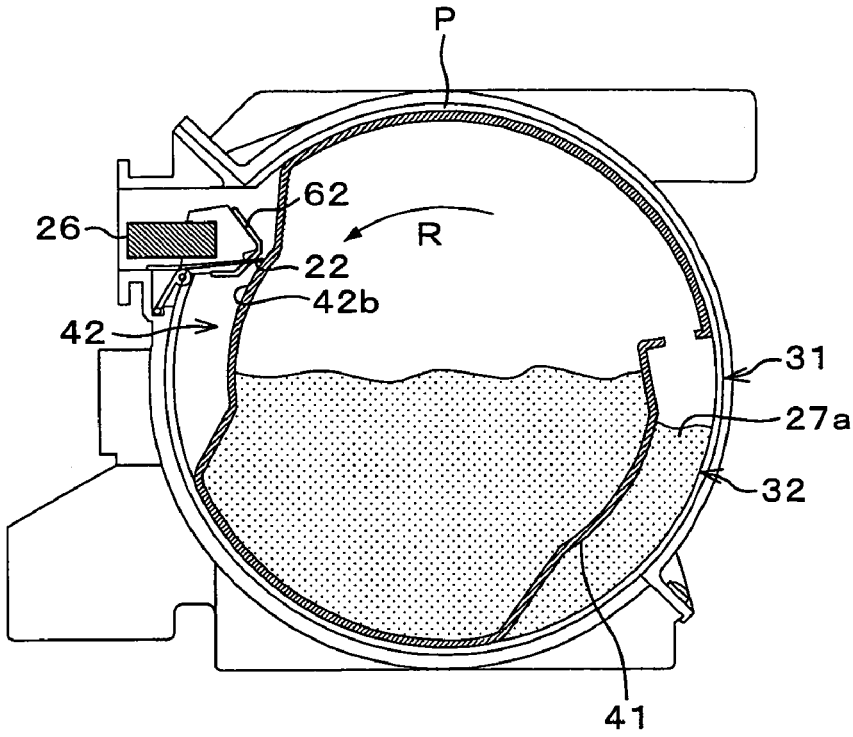
FIG. 14(*a*) illustrates the operation when toner is supplied from the toner supply device shown in FIG. 1(*a*), and is a cross sectional view showing a state where the toner ejecting sheet is placed in a second recessed portion.
Figure 14:
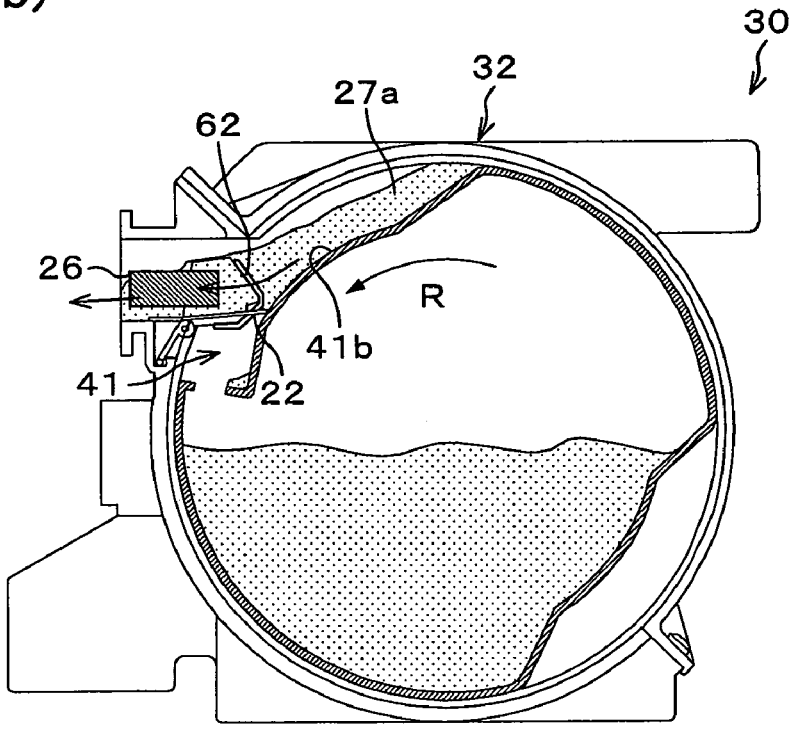

Next, the following will describe in detail the operation of the above-arranged toner supply device 30 in the printer 100 with reference to the drawings referred for the above descriptions and FIGS. 13(*a*) and 13(*b*) and FIGS. 14(*c*) and 14(*d*). FIGS. 13(*a*)-14(*b*) are cross sections for illustrating the operation of supplying toner from the toner supply device 30.

In the above-described toner supply device 30, as shown in FIG. 6, with the toner container 31 supported by the support member 32, spaces are formed respectively between the first recessed portion 41 of the recessed portion forming portion 35*a* of the third container portion 35 and the support member 32 and between the second recessed portion 42 of the recessed portion forming portion 35*a* of the third container portion 35 and the support member 32. In this state, in the printer 100, when the toner container 30 rotates about the cylinder axis under the drive force from the drive source 85 illustrated in FIG. 1, a toner placed at the first container portion 33 and the second container portion 34 of the toner container 30 (FIG. 4) is transported along the transport portions 36 and 39. At this moment, the transported toner is collected in the third container portion 35.

The toner collected in the third container portion 35 is ejected from the toner exit 43 provided in the first recessed portion 41 illustrated in FIG. 5 into the first recessed portion 41.

More specifically, as shown in FIG. 13(*a*), in a state where the first recessed portion 41 and the scraper 20 face each other, and the end of the toner ejecting sheet 22 of the scraper 20 is not in contact with the bottom wall 41*b* of the first recessed portion 41, the sheet hold portion 21*a* of the base portion 21 is held toward the third container portion 35. In the state illustrated in FIG. 13(*a*), when the toner container 31 containing the toner 27 rotates about the cylinder axis in the rotational direction R, as shown in FIG. 13(*b*), one end of the seal 62 having sealed the toner exit 43 of the first recessed portion 41 is unstuck, allowing toner to be ejected from the toner exit 43. Then, the end of the toner ejecting sheet 22 of the scraper 20 is brought into contact with the bottom wall 41*b* of the first recessed portion 41. As mentioned above, the other end of the unstuck seal 62 is kept fixed on the scraper 20. This can reliably prevent the seal 62 unstuck after opening of the sealed toner container 31 from jamming into a space of a rotation area of the toner container 31 and locking the toner container 31. That is, this can prevent the rotation of the toner container 31 from being hampered by the seal 62.

As mentioned above, the first recessed portion 41 has the toner exit 43, provided downstream in the rotational direction R of the toner container 31, communicating between the inside and outside of the toner container 31. Therefore, as shown in FIG. 13(*b*), when the toner exit 43 is brought into contact with the surface of the toner 27 in the toner container 31 by the rotation of the toner container 31, the toner is flown from the toner exit 43 into a space between the first recessed portion 41 and the support member 32 with the rotation of the toner container 31.

With the rotation of the toner container 31, when the entire first recessed portion 41 passes by the toner supply port 50 having the scraper 20 provided therein, as shown in FIG. 8(*b*), the end of the toner ejecting sheet 22 and the end of the sheet hold portion 21*a* are brought into contact with the outer circumferential surface of the recessed portion forming portion 35*a* between the first recessed portion 41 and the second recessed portion 42. At this moment, with the toner 27 held between the first recessed portion 41 and the support member 32, the toner container 31 rotates.

When the toner container 31 further rotates, as shown in FIG. 14(*a*), the second recessed portion 42 and the scraper 20 face each other, and the end of the toner ejecting sheet 22 of the scraper 20 slides along the bottom wall 42*b* of the second recessed portion 42. The second recessed portion 42 does not have an opening that communicates between the inside and the outside of the toner container 31, so that the toner 27 contained in the toner container 31 does not flow into a space between the second recessed portion 42 and the support member 32. In this case, with the toner 27*a* held in the space between the first recessed portion 41 and the support member 32, the toner container 31 rotates.

Thereafter, with the toner 27*a* held in the space between the first recessed portion 41 and the support member 32 and transported, the first recessed portion 41 faces the scraper 20 again. Then, when the end of the toner ejecting sheet 22 of the scraper 20 is brought into contact with the bottom wall 41*b* of the first recessed portion 41, as shown in FIG. 14(*b*), the toner 27*a* in the space between the first recessed portion 41 and the support member 32 is scooped up by the end of the toner ejecting sheet 22. At this moment, the bottom wall 41*b* of the first recessed portion 41 is slightly tilted substantially parallel to the outer circumferential surface of the toner container 31. This allows the toner 27*a* to be smoothly transported from the first recessed portion 41 side into the toner supply port 50, pass over the toner ejecting sheet 22.

The scraper 20 is provided with the walls 23*a* and 23*b* (FIG. 10(*a*)), so that the transported toner can be transported smoothly from the toner supply port 50 to the toner hopper 8. That is, provision of the walls 23*a* and 23*b* can prevent toner from flowing in a direction perpendicular to the transport direction of toner from the toner supply device 30 into the toner hopper 8, and can smoothly transport toner along the toner transport direction that is a direction from the toner supply device 30 side to the toner hopper 8 (FIG. 3).

Figure 15:
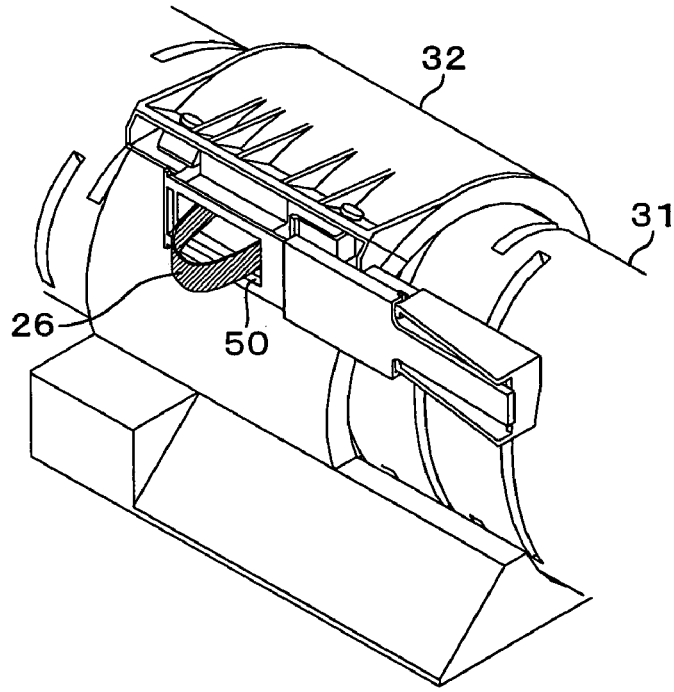
FIG. 15 is a perspective view showing a aggregation preventing member included in the toner supply device shown in FIG. 1(*a*).

Further, the aggregation preventing member 26 fixed to the walls 23*a* and 23*b* moves in parallel to the transport direction of toner above the toner transport path 52 by interlocking with the movement of the scraper 20 sliding along the recessed portion forming portion 35*a* (FIGS. 8(*a*) and 8(*b*)). Therefore, as shown in FIG. 8(*b*), when the end of the toner ejecting sheet 22 provided to the scraper 20 is brought into contact with the outer circumferential surface of the recessed portion forming portion 35*a* between the first recessed portion 41 and the second recessed portion 42, as shown in FIG. 15, the end of the aggregation preventing member 26 sticks out the toner supply port 50. That is, the end of the aggregation preventing member 26 is pushed out the opening 53 of the toner supply port 50 toward the toner hopper 8 side. This ensures the toner on the toner transport path 52 of the toner supply port 50 to be transported to the toner hopper 8 side, and thus ensures toner flow in the vicinity of the opening 53 and supply of the toner ejected from the toner container 31 to the toner hopper 8.

Figure 16:
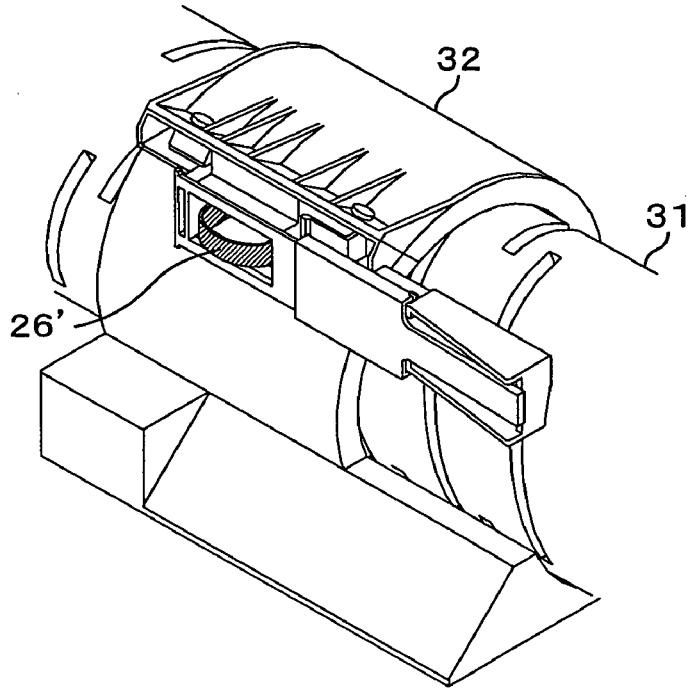
FIG. 16 is a perspective view showing another example of the aggregation preventing member shown in FIG. 15.

Note that, the present embodiment is arranged such that the end of aggregation preventing member 26 is pushed out the toner supply port 50 from the opening 53 and is stuck out toward the toner hopper 8 side. However, the present invention is not limited to this arrangement. That is, in order to ensure toner flow in the vicinity of the opening 53, as shown in FIG. 16, it can be arranged such that the end of a aggregation preventing member 26' moves to the opening 53. This arrangement also ensures toner flow in the opening 53 and transport of the toner in vicinity of the opening 53 into the toner hopper 8 side.

Further, the above description has explained that the toner is not held in the space between the second recessed portion 42 and the support member 32. In this space, a part of the toner 27*a* flown into the space between the first recessed portion 41 and the support member 32 might be held. That is, with the rotation of the toner container 31, there might occur a leakage of part of the toner 27*a* flown into the space between the first recessed portion 41 and the support member 32, to the guide flap forming portions 35*b* and 35*c* (FIG. 5) side provided to the third recessed portion of the toner container 31. In such a case, the ejection guide flaps 44*b* and 44*c* respectively provided on the guide flap forming portions 35*b* and 35*c* transport and collect the toner on the guide flap forming portions 35*b* and 35*c* to the first recessed portion 41 and the second recessed portion 42. Therefore, in the space between the first recessed portion 41 and the support member 32 (hereinafter referred to as "first space") and in the space between the second recessed portion 42 and the support member 32 (hereinafter referred to as "second space"), the toner leaked on the guide flap forming portions 35*b* and 35*c* may be held.

Thus, out of the toner leaked on the guide flap forming portions 35*b* and 35*c*, the toner collected in the first space, as has been described with reference to FIGS. 13(*a*) and 13(*b*) and FIGS. 14(*a*) and 14(*b*), is transported to the toner supply port 50, with the toner ejected from the toner exit 43 of the first recessed portion 41. On the other hand, out of the toner leaked on the guide flap forming portions 35*b* and 35*c*, the toner transported to the second space, as shown in FIG. 14(*a*), is scooped up by the end of the toner ejecting sheet 22 by sliding of the scraper 20 along the bottom wall 42*b* of the second recessed portion 42. The scooped toner is transported from the second recessed portion 42 side to the toner supply port 50, passing on the toner ejecting sheet 22. This enables the toner leaked on the guide flap forming portions 35*b* and 35*c* to be supplied for use in development into the toner hopper 8, without being wasted.

As described above, by the rotation of the toner container 31, toner can be flown into the first recessed portion 41 and be transported to the toner supply port 50. Therefore, even when the amount of remaining toner in the toner container 31 is low, the toner placed on the bottom of the toner container 31 with respect to the gravitational direction can be flown into the first space. Therefore, without great dependence upon the amount of remaining toner in the toner container 31, toner can be flown into the first space, so that the toner transported by the first recessed portion 41 can be transported through the toner supply port 50 into the toner hopper 8 side in a preferred manner.

As shown in FIG. 3, the toner supply port 50 is provided in the printer 100 such that it is above the cylinder axis L of the toner container 31. This allows the toner held in the first space to be smoothly dropped in the toner supply port 50 along the bottom wall 41*b* of the first recessed portion 41 provided in the cylindrical toner container 31. This enables a preferred supply of toner from the toner supply device 30 to the toner hopper 8.

Further, as to the toner in the space between the first recessed portion 41 and the support member 32 and the space between the second recessed portion 42 and the support member 32, the end of the toner ejecting sheet 22 included in the scraper 20 slides along the bottom wall 41*b* of the first recessed portion 41 and the bottom wall 42*b* of the second recessed portion, respectively, thereby scooping up the toner from the first recessed portion 41 and the second recessed portion 42 and scraping it to the toner supply port 50 side. This ensures the toner collected in the first space and the second space to be scooped up and scraped, so that the toner can be transported from the first recessed portion 41 and the second recessed portion 42 in the toner container 31 onto the toner transport path 52 of the toner supply port 50.

Still further, the scraper 20 is provided with the aggregation preventing member 26. Therefore, the toner transported into the toner supply port 50 by the scraper 20 can be further transported into the toner hopper 8 side by the aggregation preventing member 26. This ensures toner flow in the opening 53 of the toner supply port 50 and a smooth transport of the toner from the toner supply device 30 to the toner hopper 8.

According to the present invention, thanks to provision of the stopping member 60 that moves in the toner supply port 50 when the shutter plate 58*a* become closed, the scraper 20 can serve to scrape toner and to restrict the rotation of the tone container 31. Therefore, with a simple arrangement, it is possible to realize stabilization in amount supplied of the toner ejected out of the toner container 31 and prevention of a toner spill caused by user's operating error.

The toner having been transported into the toner hopper 8 in the manner as described above, as shown in FIG. 12, is first agitated in the toner hopper 8 by an agitating member 11. The agitating member 11 includes an agitation axis 11*a* having impellers 11*b* provided thereto. By rotation of the agitation axis 11*a*, the impellers 11*b* rotate about the agitation axis 11*a*, which agitates toner inside the toner hopper 8. Then, the toner having been agitated by the agitating member 11 is transported to a supply roller 12 side by the agitation of the agitating member 11. The supply roller 12 supplies the toner having transported by the agitating member 11 to the developing device 4.

According to the above operation, toner is ejected from the toner supply device 30, and when the amount of remaining toner in the toner container 31 becomes low, the toner supply device 30 is detached from the printer 100 so that toner can be supplied from the toner supply opening 45 (FIG. 4) of the toner container 31. Note that, the toner used in the developing device 4 is recovered by the toner recovery container 70 shown in FIGS. 21 and 22. This makes it possible to recycle the toner without wasting it.

For detachment of the toner supply device 30 from the printer 100, the above-mentioned restriction of the restricting member to the toner supply device 30 is released. Then, the toner supply device 30 is moved in a direction opposite to the direction in which the toner supply device 30 is inserted into the printer 100, and the toner supply device 30 is detached from the printer 100 according to guidance of the rib 57*a* and the mount guide portions 57*b* and 57*c* provided on the support member 32 (FIG. 6).

At this moment, the shutter displacing member provided in the printer 100, as shown in FIGS. 11(*a*) and 11(*b*), causes the shutter plate 58*a* of the shutter 58 provided on the support member 32 of the toner supply device 30 to slide. When the toner supply device 30 is installed in the printer 100, the shutter 58 is opened. When the toner supply device 30 is detached from the printer 100, the shutter displacing member allows the shutter plate 58*a* to slide such that the opened shutter 58 becomes closed. That is, as shown in FIG. 11(*b*), the shutter plate 58*a* slides such that it covers the opening 53 of the toner supply port 50.

When the shutter plate 58*a* slides so that the shutter 58 closes the toner supply port 50, toner may spill out in an area between the opening 53 and the toner opening (not shown) of the toner hopper 8 due to built-up toner in the vicinity of the opening 53 of the toner supply port 50. However, the toner supply port 50 is provided with the aggregation preventing member 26. As described earlier, the aggregation preventing member 26 pushes out toner to the toner hopper 8 side, thereby ensuring toner flow in the vicinity of the opening 53. Therefore, even when the shutter 58 operates to close the toner supply port 50, no toner spills out from the opening 53. Accordingly, it is possible to prevent the flying of toner spilt out from the opening 53 in the printer 100.

Note that, in the present embodiment, as shown in FIG. 10(*a*), the aggregation preventing member 26 (FIGS. 12(*a*) and 12(*b*)) having an arc shape with its both ends respectively fixed to the walls 23*a* and 23*b* is used. However, the shape of the aggregation preventing member is not limited to this. That is, for example, with a T-shaped or L-shaped aggregation preventing member having elasticity provided respectively to the walls 23*a* and 23*b* can also push out, toward the opening 53, toner built up on the toner transport path 52 of the toner supply port 50.

Furthers in the present embodiment, the aggregation preventing member 26 is provided to the scraper 20. However, it may be provided inside the toner supply port 50, for example. Also, in this case, it is preferable that the aggregation preventing member can push out toner built up on the toner transport path 52 in accordance with movement of the end of the toner ejecting sheet 22 of the scraper 20 placed on the toner transport path 52. That is, for example, the aggregation preventing member should be provided in a door manner such that it opens or closes by being pushed by the end of the toner ejecting sheet 22 inside the toner supply port 50. This allows the aggregation preventing member to open in the direction of the opening 53 by interlocking with movement of the scraper 20 when the scraper 20 slides along the recessed portion forming portion 35*a* of the toner container 31, thus pushing out toner built up on the toner transport path 52.

The present invention may be rephrased as follows.

[1] A developer supply device (toner supply device 30) detachably installed in a developing device 4 of an image forming apparatus (printer 100), in which a developer container (toner container 31) of the developer supply device is rotated in the direction of a cylinder axis L of the developer container so that a developer (e.g. toner) is supplied from an exit (toner exit 43) on the side wall of the developer container, and when the developer supply device is detached from the developing device, a developer supply port (toner supply port 53) is closed by a shutter mechanism (shutter 58) and the rotation of the developer container is stopped, the developer supply device being characterized in that the rotational position of the developer container is detected and the rotation of the developer container is controlled so as to stop at a predetermined position, so that the rotation of the developer container is stopped.

According to this arrangement, when the rotational position of the toner container is controlled and the rotation by which the toner is supplied is stopped, the rotation is stopped at a predetermined position in such a way as to always keep the toner supply port to be on the upper side and allow the shutter mechanism to properly operate. This prevents troubles such as poor toner supply and pollution by the toner on account of the coagulation of the toner leaked from the toner container and malfunction of the shutter mechanism, and makes it possible to achieve proper supply of the developer. It is noted that the aforesaid "the toner supply port to be on the upper side" indicates that the toner supply port 50 (toner exit 43) of the toner container 31 is vertically above the boundary surface of the toner.

[2] The developer supply device as defined in [1] is characterized in that a connection portion (coupling portion) between the developer container and a driving mechanism (drive section) for rotating the developer container is arranged so as to be always coupled with the drive section side in only one rotational positional relationship, and the driving side is always stopped at a predetermined rotational position.

According to this arrangement, the rotation of the driving side is always stopped at a predetermined position, and the toner container and the driving side are coupled with each other at only one rotational position. On this account, the rotation of the toner container is always stopped at a predetermined position.

[3] The developer supply device as defined in [2] is characterized in that the connection portion is made up of a joint receiving means (joint receiving section 81), and one protrusion to be coupled (connected) is provided on the joint receiving means (drive-section-side connection portion 87*a* or 87*b*), while the other protrusion to be coupled is provided on the toner container (container-side connection portion 37*a* or 37*b*).

According to this arrangement, each of the joint receiving means and the developer container has only one coupling protrusion (connection portion), so that a positional relationship in terms of the coupling between the developer container and the drive section side is uniquely determined. On this account, the developer container is always stopped at a predetermined rotational position by stopping the drive section at a predetermined rotational position.

[4] The developer supply device as defined in [2] is characterized in that there are plural pairs of protrusions at which the connection portion is coupled, and the positions of these protrusions are radially different from each other.

According to this arrangement, plural pairs of coupling protrusions on the joints of the joint receiving means (drive-section-side connection portions 87*a* and 87*b*) and on the developer-container-side connection portions (container-side connection portions 37*a* and 37*b*) are positionally different from each other in a radial direction. This causes the developer container and the drive section to be coupled with each other in only one combination, so that the positional relationship in terms of coupling between the developer container and the drive section is uniquely determined. On this account, the developer container is always stopped at a predetermined rotational position by stopping the drive section at a predetermined rotational position.

[5] An image forming apparatus is provided with the developer supply device of [1]-[4].

This arrangement enables the image forming apparatus to attain the aforesaid effects, and image formation is always properly carried out without any troubles.

The invention is not limited to the above-described embodiment, and variations can be effected within the scope of the claims. An embodiment as a combination of technical means with variations within the scope of the claims is not to be regarded as a departure from the spirit and scope of the invention.

A developer supply device of the present invention is detachably installed in a developer device provided in an electrophotographic image forming apparatus such as a printer, photocopier, and a facsimile machine. The developer supply device of the present invention can stop the rotation of the developer container at a position where the exit is above the boundary surface of the developer. On this account, it is possible to prevent troubles such as poor supply of the developer and pollution on account of developer leakage from occurring, making it possible to stably and properly supply the developer.

As described above, the developer supply device of the present invention, which is detachably installed in an image forming apparatus and supplies developer to an outside of the developer supply device by rotating a cylindrical developer container containing the developer on an axis line of the developer container as a rotation axis, is characterized by comprising: an exit in a recessed portion provided on an outer circumferential surface of the developer container; a support member, by surrounding at least a recessed portion forming region formed around the outer circumferential surface along a direction of rotation of the developer container so as to include an area where the recessed portion is provided, rotatably holding the developer container, and having a developer supply port for supplying, to the outside of the developer supply device, the developer ejected from the exit into the recessed portion; a scraping member, provided in the developer supply port so as to slide along the recessed portion forming region during rotation of the developer container, scraping the developer in the recessed portion by sliding along the recessed portion in the recessed portion forming region; a shutter provided in the support member, for opening and closing the developer supply port; and a position detection section stopping rotation of the developer container at a position where the exit is above a boundary surface of the developer.

According to this arrangement, the position detection section stops the rotation of the developer container, at a position where the exit is above the boundary surface of the developer. With this, when the developer container stops the rotation, the developer does not flow into the recessed portion from the exit. In other words, the exit is left open. On this account, even if the developer container is left without rotation for a long period of time, the toner in the recessed portion does not coagulate. This prevents troubles caused by the developer in the recessed portion, at the time of reactivation (restarting the rotation of the developer container).

Also, according to the arrangement above, the shutter makes the developer supply port open when the developer supply device is attached to the image forming apparatus, while the developer supply port closed when the developer supply device is detached from the image forming apparatus. On this account, even if the developer supply device is detached from the image forming apparatus while the developer container still contains the developer, the developer supply port is closed. It is therefore possible to prevent the developer from leaking through the developer supply port, at the time of detaching or attaching the developer supply device.

As described above, when the rotation stops, the exit is above the boundary surface of the developer. Moreover, the rotation of the developer container has been stopped at the time of detaching the developer supply device. On this account, the developer discharged to the recessed portion does not leak through the developer supply port, even when the developer supply device is detached and the developer supply port is closed by the shutter. In short, it is possible to always keep the shutter to properly operate.

On the contrary, in the conventional developer supply device, at what position the rotation of the developer container stops is not particularly determined, so that the rotation of the developer container may stop at a position where the exit is below the boundary surface of the developer. At this position, the developer flows into the recessed portion through the exit, on account of the weight and pressure of the developer. If the developer supply device is left in this state for a long period of time, a pressure is applied to the recessed portion on account of the weight of the developer and on the occasion of the inflow of the developer into the recessed portion, causing the unused developer to coagulate in the recessed portion. At the time of reactivating the developer supply device, the coagulated developer imposes a heavy load on the developer supply device, and this may induce troubles such as malfunction of the shutter mechanism and poor image quality on account of short supply of the developer. Also, even if the developer supply device in which the developer coagulates is detached and the shutter is closed, the developer in the recessed portion does not flow into the developer supply port. For this reason, the developer leaks from the recessed portion at the time of detaching the developer supply device. More specifically, at the time of supplying the developer, the exit rotates but the shutter independent of the exit does not rotate. On this account, when the rotation of the developer container stops at a position where the exit is below the boundary surface of the developer, the toner flows into the recessed portion, so as to coagulate. As a result, the developer hardly flows out even if the developer container rotates and reaches a position where the developer is discharged. The developer therefore remains in the developer supply port. This obstructs the movement of the shutter, thereby inducing such a trouble that the developer leaks out as the shutter does not properly operate. In this manner, in the conventional developer supply device, the shutter may not properly operate.

In this manner, according to the present invention, at what position the rotation of the developer container stops is controlled by the position detection section, so that the shutter properly operates. Also possible is prevention of coagulation of the developer in the recessed portion and the leakage of the developer through the developer supply port at the time of detaching or attaching the developer supply device. On this account, it is possible to prevent troubles such as poor supply of the developer and pollution on account of developer leakage from occurring, making it possible to stably and properly supply the developer.

The developer supply device of the present invention may be arranged in such a manner that, a drive section, which imparts a rotational driving power to the developer container, is coupled with the developer container, by at least one drive-section-side connection portion on the drive section and at least one container-side connection portion on the developer container, and the at least one drive-section-side connection portion and the at least one container-side connection portion are coupled with one another in a single coupling pattern.

According to this arrangement, the drive section and the developer container are coupled with each other in a unique coupling pattern. In other words, a positional relationship (coupling state) achieved by the connection portions is uniquely determined. Also, the developer container rotates with this positional relationship being maintained. On this account, it is possible to control at what position the rotation of the developer container stops, from either the drive section side or the developer container side.

In addition to the above, the developer supply device of the present invention may be arranged in such a manner that the position detection section controls at what position the drive section stops rotation, so that rotation of the developer container stops at a position where the exit is above the boundary surface of the developer.

According to this arrangement, the position detection section controls at what position the rotation of the drive section stops, so that at what position the rotation of the developer container stops is controlled. On this account, it is unnecessary to provide, in the developer container, a member for controlling at what position the rotation of the developer container stops. This allows the developer container to do away with a member for controlling the position where the rotation stops, by controlling, on the drive section side, at what position the rotation of a disposable developer container (or developer supply device) stops. This makes it possible to reduce costs for manufacturing, in particular, a disposable developer container (or developer supply device).

In addition to the above, the developer supply device of the present invention may be arranged in such a manner that the drive section and the developer container are connected by a pair of the drive-section-side coupling portion and the container-side coupling portion.

According to this arrangement, the drive section and the developer container are coupled with each other by a pair of connection portions (one drive-section-side connection portion and one container-side connection portion). A positional relationship (coupling state) of this pair of connection portions is uniquely determined (unique coupling pattern). This simplifies the arrangement of the connection portions for coupling the drive section with the developer container.

The developer supply device of the present invention may be arranged in such a manner that the drive section and the developer container are coupled with each other by plural pairs of the drive-section-side connection portions and the container-side connection portions.

According to this arrangement, the drive section and the developer container are coupled with each other by plural pairs of the drive-section-side connection portions and the container-side connection portions (each pair is made up of one drive-section-side connection portion and one container-side connection portion). A positional relationship (coupling state) of these pairs of connection portions is uniquely determined (unique coupling pattern). That is, the pairs of the connection portions are coupled with one another only in one combination. With these pairs of the connection portions, the driving force from the drive section is surely transmitted to the developer container. On this account, the rotation of the developer container is stably carried out.

As described above, the image forming apparatus of the present invention is provided with one of the aforesaid developer supply devices installed in the apparatus in a detachable manner.

According to this arrangement, the developer supply device installed in the image forming apparatus can restrict the rotation of the developer container, especially at what position the rotation stops. This allows the shutter to properly operate, and prevent the developer from coagulating in the recessed portion and the developer from leaking through the developer supply port. On this account, it is possible to prevent troubles such as poor supply of the developer and pollution on account of developer leakage from occurring, making it possible to stably and properly supply the developer.

In the image forming apparatus of the present invention, the developer supply device may be installed in such a way as to keep the developer supply port to be above the axis of the developer container.

According to this arrangement, by the rotation of the developer container and by utilizing free fall of the developer in the recessed portion of the developer container, the developer is properly scraped out by a scraper and transported to the developer supply port.

Specific embodiments or examples implemented in the description of the embodiments only show technical features of the present invention and are not intended to limit the scope of the invention. Variations can be effected within the spirit of the present invention and the scope of the following claims.

What is claimed is:

1. A developer supply device which is detachably installed in an image forming apparatus and supplies developer to an outside of the developer supply device by rotating a cylindrical developer container containing the developer on an axis line of the developer container as a rotation axis, the developer supply device comprising:

an exit in a recessed portion provided on an outer circumferential surface of the developer container;

a support member, by surrounding at least a recessed portion forming region formed around the outer circumferential surface along a direction of rotation of the developer container so as to include an area where the recessed portion is provided, rotatably holding the developer container, and having a developer supply port for supplying, to the outside of the developer supply device, the developer ejected from the exit into the recessed portion;

a scraping member, provided in the developer supply port so as to slide along the recessed portion forming region during rotation of the developer container, scraping the developer in the recessed portion by sliding along the recessed portion in the recessed portion forming region;

a shutter provided in the support member, for opening and closing the developer supply port; and a position detection section stopping rotation of the developer container at a position where the exit is above a boundary surface of the developer.

2. The developer supply device as defined in claim 1, wherein, a drive section, which imparts a rotational driving power to the developer container, is coupled with the developer container, by at least one drive-section-side connection portion on the drive section and at least one container-side connection portion on the developer container, and the at least one drive-section-side connection portion and the at least one container-side connection portion are coupled with one another in a single coupling pattern.

3. The developer supply device as defined in claim 2, wherein, the position detection section controls at what position the drive section stops rotation, so that rotation of the developer container stops at a position where the exit is above the boundary surface of the developer.

4. The developer supply device as defined in claim 1, wherein, the shutter opens the developer supply port when the developer supply device is installed in the image forming apparatus, while the shutter closes the developer supply port when the developer supply device is detached from the image forming apparatus.

5. The developer supply device as defined in claim 1, further comprising a stopping member pushing the scraping member into the recessed portion, by interlocking with closing movement of the shutter, and restricting the rotation of the developer container.

6. The developer supply device as defined in claim 5, wherein, the stopping member is made of polyacetal resin or acrylonitrile butadiene styrene resin.

7. The developer supply device as defined in claim 5, further comprising an aggregation preventing member deforming in such a manner as to nestle along the stopping member, when pushed by the stopping member.

8. The developer supply device as defined in claim 7, wherein, the aggregation preventing member is sheet-shaped and made of an elastic material.

9. An image forming apparatus comprising, in a detachable manner, a developer supply device which supplies developer to an outside of the developer supply device by rotating a cylindrical developer container containing the developer on an axis line of the developer container as a rotation axis, the developer supply device including:

an exit in a recessed portion provided on an outer circumferential surface of the developer container;

a support member, by surrounding at least a recessed portion forming region formed around the outer circumferential surface along a direction of rotation of the developer container so as to include an area where the recessed portion is provided, rotatably holding the developer container, and having a developer supply port for supplying, to the outside of the developer supply device, the developer ejected from the exit into the recessed portion;

a scraping member, provided in the developer supply port so as to slide along the recessed portion forming region during rotation of the developer container, scraping the developer in the recessed portion by sliding along the recessed portion in the recessed portion forming region;

a shutter provided in the support member, for opening and closing the developer supply port; and a position detection section stopping the developer container at a position where the exit is above a boundary surface of the developer.

10. The image forming apparatus as defined in claim 9, wherein, the developer supply device is provided in such a manner as to keep the developer supply port above the axis line of the developer container.

11. The image forming apparatus as defined in claim 9, wherein, a drive section, which imparts a rotational driving power to the developer container, is coupled with the developer container, by at least one drive-section-side connection portion on the drive section and at least one container-side connection portion on the developer container, and the at least one drive-section-side connection portion and the at least one container-side connection portion are coupled with one another in a single coupling pattern.

12. The image forming apparatus as defined in claim 11, wherein, the position detection section controls at what position the drive section stops rotation, so that rotation of the developer container stops at a position where the exit is above the boundary surface of the developer.

13. The image forming apparatus as defined in claim 9, wherein, the shutter opens the developer supply port when the developer supply device is installed in the image forming apparatus, while the shutter closes the developer supply port when the developer supply device is detached from the image forming apparatus.

14. The image forming apparatus as defined in claim 9, further comprising a stopping member pushing the scraping member into the recessed portion, by interlocking with closing movement of the shutter, and restricting the rotation of the developer container.

15. The image forming apparatus as defined in claim 14, wherein, the stopping member is made of polyacetal resin or acrylonitrile butadiene styrene resin.

16. The image forming apparatus as defined in claim 14, further comprising an aggregation preventing member deforming in such a manner as to nestle along the stopping member, when pushed by the stopping member.

17. The image forming apparatus as defined in claim 16, wherein, the aggregation preventing member is sheet-shaped and made of an elastic material.

* * * * *